US011647324B2

(12) United States Patent
Wilk et al.

(10) Patent No.: US 11,647,324 B2
(45) **Date of Patent: *May 9, 2023**

(54) AUDIO SPEAKER HAVING A RIGID ADSORPTIVE INSERT

(71) Applicant: Apple Inc., Cupertino, CA (US)

(72) Inventors: Christopher Wilk, Los Gatos, CA (US); Ruchir M. Dave, San Jose, CA (US); Scott P. Porter, San Jose, CA (US); Daniel T. McDonald, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/170,694

(22) Filed: Feb. 8, 2021

(65) Prior Publication Data

US 2021/0195317 A1 Jun. 24, 2021

Related U.S. Application Data

(63) Continuation of application No. 16/268,267, filed on Feb. 5, 2019, now Pat. No. 10,917,713, which is a continuation of application No. 15/198,852, filed on Jun. 30, 2016, now Pat. No. 10,244,308.

(60) Provisional application No. 62/210,766, filed on Aug. 27, 2015.

(51) Int. Cl.
*H04R 25/00* (2006.01)
*H04R 1/28* (2006.01)

(52) U.S. Cl.
CPC ..... *H04R 1/2811* (2013.01); *H04R 2201/029* (2013.01)

(58) Field of Classification Search
CPC ..... H04R 1/2811; H04R 2201/029
See application file for complete search history.

(56) References Cited

U.S. PATENT DOCUMENTS

| | | | | |
|---|---|---|---|---|
| 7,974,423 | B2 * | 7/2011 | Matsumura | H04R 1/2803 181/149 |
| 8,848,960 | B2 * | 9/2014 | Yamazaki | H04R 1/2803 381/345 |
| 10,244,308 | B2 * | 3/2019 | Wilk | H04R 1/2811 |
| 2008/0135327 | A1 * | 6/2008 | Matsumura | E01F 8/0011 181/294 |
| 2008/0170737 | A1 * | 7/2008 | Saiki | H04R 1/2803 381/346 |
| 2013/0308812 | A1 * | 11/2013 | Shen | H04R 1/288 381/346 |

OTHER PUBLICATIONS

Chinese Office Action from related Chinese Patent Application No. 201910766341.2 dated May 8, 2021 (13 pages including translation).

* cited by examiner

*Primary Examiner* — Phylesha Dabney
(74) *Attorney, Agent, or Firm* — Aikin & Gallant, LLP

(57) ABSTRACT

An audio speaker having an adsorptive insert in a speaker back volume, is disclosed. More particularly, an embodiment includes an adsorptive insert having a rigid open-pore body formed by bonded adsorptive particles. The rigid open-pore body includes interconnected macropores that transport air from the speaker back volume to adsorptive micropores in the bonded adsorptive particles during sound generation. Other embodiments are also described and claimed.

20 Claims, 15 Drawing Sheets

A - A

C - C

B - B

A - A

D - D

E - E

AUDIO SPEAKER HAVING A RIGID ADSORPTIVE INSERT

RELATED APPLICATIONS

The present application is a continuation application of co-pending U.S. patent application Ser. No. 16/268,267 filed Feb. 5, 2019, which is a continuation application of U.S. patent application Ser. No. 15/198,852, filed Jun. 30, 2016, which claims the benefit of U.S. Provisional Patent Application No. 62/210,766, filed Aug. 27, 2015, and those applications are incorporated herein by reference in their entirety.

BACKGROUND

Field

Embodiments related to an audio speaker having an adsorptive insert in a speaker back volume, are disclosed. More particularly, an embodiment includes an adsorptive insert having a rigid open-pore body formed by bonded adsorptive particles. The rigid open-pore body includes interconnected macropores that transport air from the speaker back volume to adsorptive micropores in the bonded adsorptive particles during sound generation.

Background Information

A portable consumer electronics device, such as a mobile phone, a tablet computer, or a portable media device, typically includes a system enclosure surrounding internal system components, such as audio speakers. Such devices may have small form factors with limited internal space, and thus, the integrated audio speakers may be micro speakers, also known as microdrivers, that are miniaturized implementations of loudspeakers having a broad frequency range. Due to their small size, micro speakers tend to have limited space available for a back volume. Furthermore, given that acoustic performance in the low frequency audio range usually correlates directly with the back volume size, micro speakers tend to have limited performance in the bass range. The low frequency acoustic performance of portable consumer electronics devices having micro speakers may be increased, however, by increasing the back volume size as much as possible within the internal space available in the system enclosure.

SUMMARY

Portable consumer electronics devices, such as mobile phones, have continued to become more and more compact. As the form factor of such devices shrinks, system enclosures become smaller and the space available for speaker integration is reduced. More particularly, the space available for a speaker back volume decreases, and along with it, low frequency acoustic performance diminishes. The effective back volume of a portable consumer electronics device may, however, be increased without increasing the actual physical size of the back volume. More particularly, an adsorbent material may be incorporated within the back volume to lower the frequency of the natural resonance peak and thereby make bass sounds louder. The adsorbent material may reduce the spring rate of the speaker by adsorbing and desorbing air molecules as pressure fluctuates within the back volume during sound generation. Such adsorption/desorption can increase system efficiency at lower frequencies to produce more audio power. Thus, the audio speaker may produce better sound in the same form factor, or produce equivalent sound in a smaller form factor.

Directly incorporating an adsorbent material within the back volume to improve acoustic performance may, however, cause negative side effects. In particular, incorporating loose adsorbent particles directly within the back volume may create a system that is physically unbalanced and susceptible to damage as the particles shift, e.g., due to the mobile device being carried or moved by a user. Furthermore, attempting to mitigate these effects by packaging the adsorbent particles in a secondary enclosure such as a mesh bag located in the back volume may cost precious enclosure space, as the secondary enclosure walls occupy vertical clearance in the back volume. Thus, for adsorbent materials to be used in a speaker back volume to enhance acoustic performance within the smallest possible form factor, an audio speaker having an adsorptive insert that is physically stable and efficiently utilizes the available back volume may be needed.

In an embodiment, an audio speaker includes a physically stable adsorptive insert that is located in, and occupies a substantial portion of, a speaker back volume. The audio speaker incudes a speaker housing having a speaker port and an inner surface. A loudspeaker may be mounted in the speaker port to define the back volume between the loudspeaker and the inner surface. The adsorptive insert that is located in the back volume includes adsorptive particles bound together to form a rigid open-pore body having an outer surface surrounding a spatial volume. The spatial volume occupied by the monolithic open-pore body may be a same order of magnitude as the back volume, e.g., the spatial volume may occupy a majority of the back volume. In an embodiment, the rigid open-pore body includes macropores along the outer surface and between the bonded adsorptive particles, and the macropores are interconnected to transport air from the back volume to micropores within the bonded adsorptive particles. The rigid open-pore body may have a lower porosity than loosely packed, i.e., not bonded, adsorptive particles. For example, the interconnected macropores may occupy less than 60% of the spatial volume of the open-pore body. In an embodiment, the bonded adsorptive particles occupy a majority of the spatial volume, e.g., more than 75% of the spatial volume.

All of the outer surface of the open-pore body may be spaced apart from the inner surface of the speaker housing. For example, spacers may be located between the inner surface and the outer surface. In an embodiment, the spacers include an open-cell spacer that allows air to move freely from the back volume to the open-pore body through channels within the open-cell spacer. To that end, the open-cell spacer may be an open-cell foam material that includes a first porous surface disposed against the outer surface and a second porous surface exposed to air in the back volume between the inner surface and outer surface. The first porous surface may be placed in fluid communication with the second porous surface through the interconnected channels to transport air from the back volume to the macropores along the outer surface.

In an embodiment, substantially all of (and not necessarily all of) the outer surface of the open-pore body may be spaced apart from the inner surface of the speaker housing. For example, the adsorptive insert may include one or more protrusions extending from a surrounding portion of the outer surface, and the protrusions may be spacers. That is, the protrusions may have respective apices disposed against the inner surface to stabilize the open-pore body within the back volume and maintain a spaced apart relationship between the open-pore body and the speaker housing. As such, the apices may represent a portion of the outer surface that is in contact with, and not spaced apart from, the inner surface. The apices may, however, have a combined surface area that is substantially less than the total outer surface area. For example, the combined surface area of the apices may be less than 10% of the total surface area of the outer surface to ensure that at least 90% of the outer surface is spaced apart from the inner surface and placed in fluid communication with the back volume.

In an embodiment, a portion of the outer surface of the open-pore body conforms to an opposing portion of the inner surface of the speaker housing. For example, part of the outer surface that is spaced apart from the inner surface may include an outer contour opposing an inner contour of the inner surface, and the contours may have matching shapes. The outer contour and inner contour may both include curvatures or corners that are negative shapes of each other. Thus, the open-pore body may conform to the speaker housing to efficiently utilize the back volume.

In an embodiment, an audio speaker includes an adsorptive insert with a hierarchical open-pore body. For example, the open-pore body, which may be formed from bonded adsorptive particles, may include a core region and a shell region surrounding the core region. The shell region can include the outer surface surrounding the spatial volume of the hierarchical open-pore body. Furthermore, macropores may be interconnected throughout the open-pore body, within both the core region and the shell region. The macropores in the shell region, however, may be larger on average than the macropores in the core region. For example, interconnected macropores in the shell region may occupy less than 60% of the shell volume, while interconnected macropores in the core region may occupy less than 30% of the shell volume. Thus, the hierarchical macroscopic network may funnel air from the back volume through smaller and smaller macropores to micropores in the bonded adsorptive particles of the core region.

In an embodiment, a method of fabricating an audio speaker includes assembling a loudspeaker, a speaker housing, and an adsorptive insert. The method may include forming, e.g., through plastic or metal molding processes, the speaker housing having a speaker port and an inner surface defining a rear cavity. The method may also include forming a rigid open-pore body, by bonding adsorptive particles together. Various bonding techniques may be used to bond the adsorptive particles, including techniques that employ one or more of heat or pressure, e.g., sintering techniques. As a result of the bonding techniques, the rigid open-pore body may be a monolithic structure having an outer surface surrounding a spatial volume. Furthermore, as a result of the bonding process, a network of interconnected macropores may be located along the outer surface and between the bonded adsorptive particles. Optionally, the rigid open-pore body may be shaped by removing bonded adsorptive particles from the outer surface to create an outer contour that has a shape matching and conforming to a same shape of an inner contour of the inner surface of the speaker housing. The adsorptive insert having the rigid open-pore body may be inserted into the rear cavity. In an embodiment, the rigid open-pore body is spaced apart from the speaker housing by positioning a spacer, e.g., an open-cell spacer, between the rigid open-pore body and the speaker housing. Furthermore, the loudspeaker may be located in the speaker port to define a back volume between the loudspeaker and the inner surface. The back volume may be a same order of magnitude as the spatial volume occupied by the open-pore body. Thus, during sound generation by the loudspeaker, air may be transported from the back volume, through the open-cell spacer, and into the interconnected macropores of the open-pore body to be adsorbed and/or desorbed by micropores in the bonded adsorptive particles.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
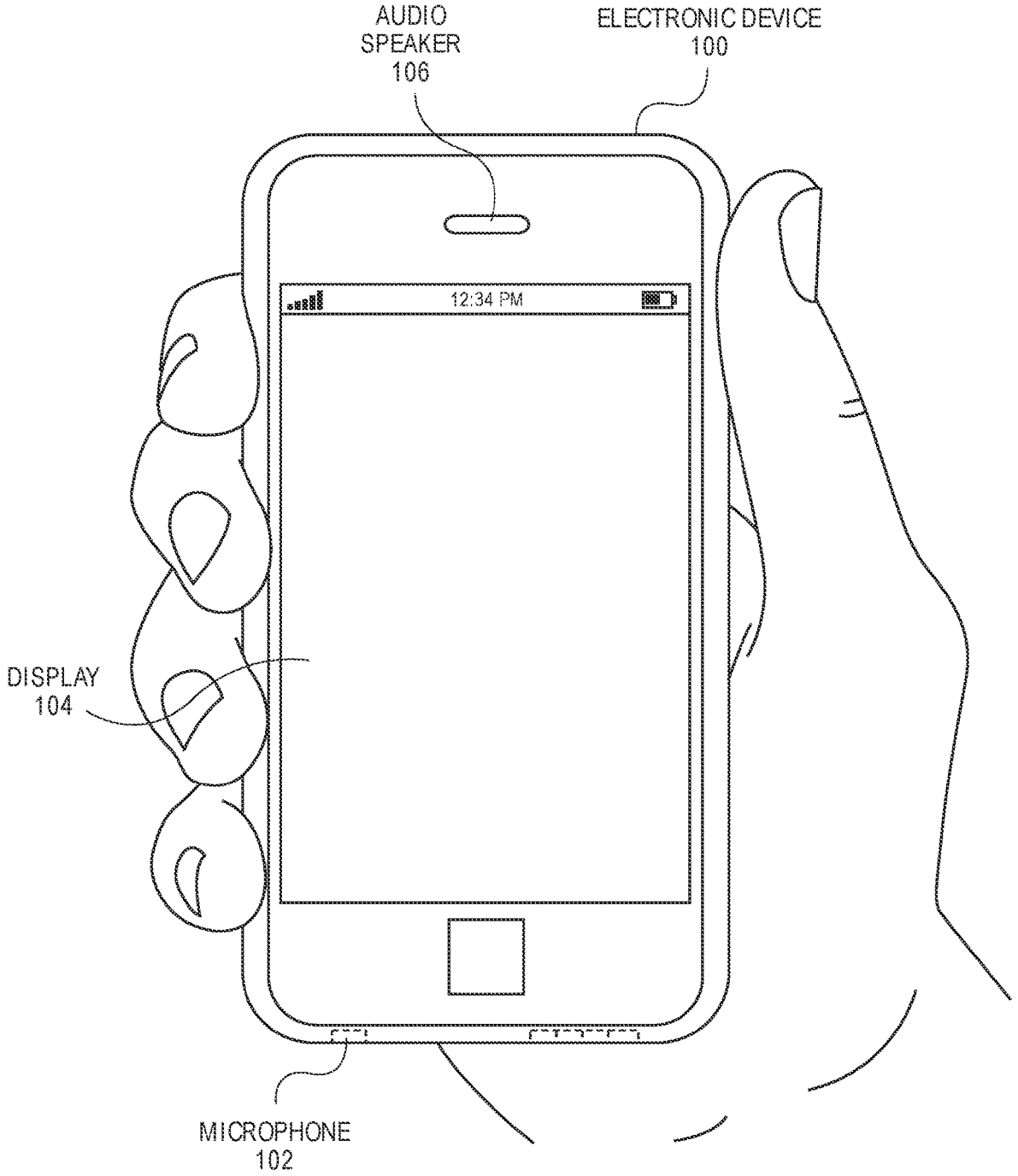
FIG. 1 is a pictorial view of an electronic device in accordance with an embodiment.

Embodiments describe an audio speaker having a speaker housing surrounding a back volume and a rigid adsorptive insert in the back volume. However, while some embodiments are described with specific regard to integration within mobile electronics devices, such as handheld devices, the embodiments are not so limited and certain embodiments may also be applicable to other uses. For example, an audio speaker as described below may be incorporated into other devices and apparatuses, including desktop computers, laptop computers, or motor vehicles, to name only a few possible applications.

In various embodiments, description is made with reference to the figures. However, certain embodiments may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description may denote a relative position or direction. For example, "front" may indicate a first direction away from a reference point. Similarly, "lateral" may indicate a location in a second direction orthogonal to the first direction. However, such terms are provided to establish relative frames of reference, and are not intended to limit the use or orientation of an audio speaker (or components of the audio speaker) to a specific configuration described in the various embodiments below.

In an aspect, an audio speaker includes an adsorptive insert in a speaker back volume. The adsorptive insert includes adsorptive particles, e.g., zeolite or activated carbon particles, that are bound together to form a rigid open-pore body with a network of interconnected passages, or macropores, between the bonded adsorptive particles. Furthermore, the adsorptive particles may each include micropores that are sized to adsorb air, e.g., oxygen, nitrogen, or other constituent molecules of air. Thus, the rigid open-pore body provides a transportation network for air to be moved, e.g., by pressure waves during sound generation, from the back volume, through the macropores, and into (or out of) the micropores. The rigid open-pore body may be a hierarchical open-pore body having a network of air passages that include macropores that reduce in size from an outer surface of the rigid open-pore body toward a core at the center of the rigid open-pore body. Such a hierarchical open-pore body may allow air to migrate more easily to the center of the rigid open-pore body, allowing free movement of air in an open-pore body occupying a spatial volume that has a same order of magnitude as the speaker back volume. Accordingly, the adsorptive insert having a rigid open-pore body allows for the adsorption and desorption of air molecules in response to pressure variations, which can lower the natural resonance peak of the audio speaker.

In an aspect, a rigid open-pore body of an adsorptive insert in a speaker back volume is spaced apart from an inner surface of a speaker housing that defines the speaker back volume. For example, an outer surface of the rigid open-pore body may be entirely spaced apart from the inner surface. Full separation may be achieved by placing one or more spacers between the outer surface of the rigid open-pore body and the inner surface of the speaker housing. Alternatively, the outer surface of the rigid open-pore body may be substantially separated from the inner surface, i.e., the outer surface and the inner surface may contact each other minimally, as in the case where one or more protrusions extend from the rigid open-pore body to contact the inner surface at apices that have contact surface areas that are one or more orders of magnitude smaller than a total surface area of the outer surface. Thus, the rigid open-pore body may be maximally exposed to air, and the adsorptive insert may also be stabilized and/or cushioned within the speaker housing to reduce the likelihood of damage to sensitive speaker components, such as a voicecoil or a diaphragm of a loudspeaker mounted in the speaker housing.

In an aspect, a method of manufacturing an audio speaker having an adsorptive insert within a speaker housing includes operations for bonding adsorptive particles together to form a rigid open-pore body that includes a network of macropores to transport air from a speaker back volume to micropores of the bonded adsorptive particles. The operations for bonding adsorptive particle may include processing techniques to form a hierarchical open-pore body having a network of air pathways that includes macropores that reduce in size from an outer surface of the rigid open-pore body toward a core at a center of the rigid open-pore body. Furthermore, the operations may include removing portions of the bonded adsorptive particle to shape the rigid open-pore body such that an outer contour of the adsorptive insert conforms to an inner contour of the speaker housing, e.g., the components may include matching corner or curvature geometries. Thus, an adsorptive insert may be formed that efficiently utilizes the available back volume by conforming to the internal shape of the speaker housing.

Referring to FIG. 1, a pictorial view of an electronic device is shown in accordance with an embodiment. Electronic device 100 may be a smartphone device. Alternatively, it could be any other portable or stationary device or apparatus, such as a laptop computer or a tablet computer. Electronic device 100 may include various capabilities to allow the user to access features involving, for example, calls, voicemail, music, e-mail, internet browsing, scheduling, and photos. Electronic device 100 may also include hardware to facilitate such capabilities. For example, an integrated microphone 102 may pick up the voice of a user during a call, and an audio speaker 106, e.g., a micro speaker, may deliver a far-end voice to the near-end user during the call. Audio speaker 106 may also emit sounds associated with music files played by a music player application running on electronic device 100. A display 104 may present the user with a graphical user interface to allow the user to interact with electronic device 100 and/or applications running on electronic device 100. Other conventional features are not shown but may of course be included in electronic device 100.

Figure 2:
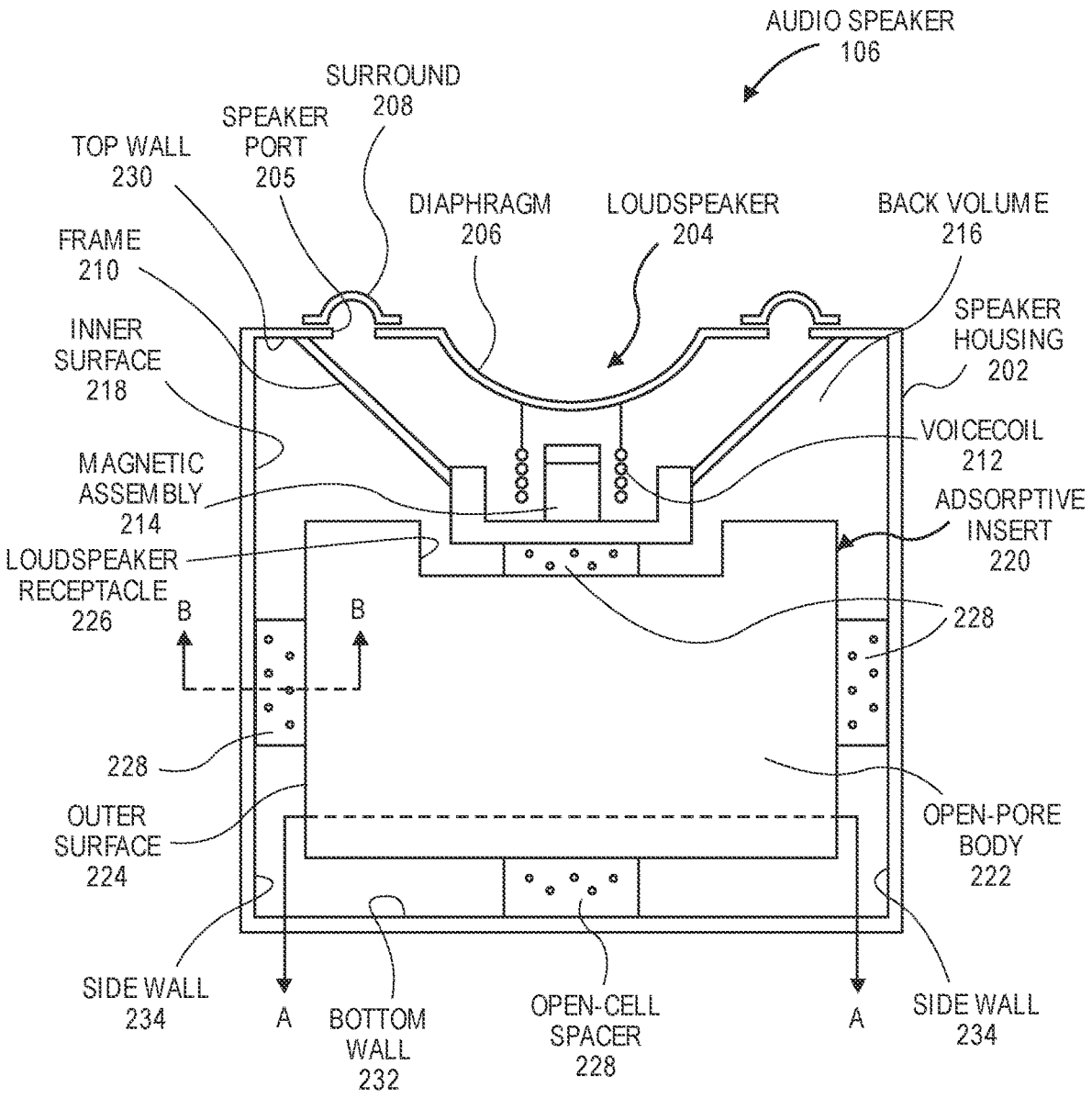
FIG. 2 is a sectional view of an audio speaker having an adsorptive insert within a speaker housing in accordance with an embodiment.

Referring to FIG. 2, a sectional view of an audio speaker having an adsorptive insert within a speaker housing is shown in accordance with an embodiment. Audio speaker 106 includes an enclosure, which may be a speaker housing 202 that supports a loudspeaker 204. More particularly, speaker housing 202 may include a speaker port 205, e.g., a hole formed in a wall of speaker housing 202, and loudspeaker 204 may be mounted on speaker housing 202 in speaker port 205. Loudspeaker 204 may be any of a variety of electroacoustic transducers, such as micro speakers, that include a speaker driver to convert an electrical audio signal into a sound. For example, loudspeaker 204 may be a micro speaker having a diaphragm 206 supported relative to speaker housing 202 and/or a speaker frame 210. Diaphragm 206 may be connected to speaker housing 202 by a surround 208. Surround 208 flexes to permit axial motion of diaphragm 206 along a central axis to produce sound. For example, loudspeaker 204 may have a motor assembly attached to diaphragm 206 to move diaphragm 206 axially with pistonic motion, i.e., forward and backward, along the central axis. The motor assembly may include a voicecoil 212 that moves relative to a magnetic assembly 214. In an embodiment, magnetic assembly 214 includes a magnet, such as a permanent magnet, attached to a top plate at a front face and to a yoke at a back face. The top plate and yoke may be formed from magnetic materials to create a magnetic circuit having a magnetic gap within which voicecoil 212 oscillates forward and backward. Thus, when the electrical audio signal is input to voicecoil 212, a mechanical force may be generated that moves diaphragm 206 to radiate sound forward along the central axis into a surrounding environment outside of speaker housing 202. Similarly, oscillation of diaphragm 206 radiates sound rearward into a back volume 216 between loudspeaker 204 and speaker housing 202.

Back volume 216 may be a spatial volume defined between loudspeaker 204 and an inner surface 218 of speaker housing 202. For example, when loudspeaker 204 is mounted in speaker port 205, back volume 216 may include the volume of air behind diaphragm 206 and within a rear cavity defined by the inner surface 218 of speaker housing 202, including the volume of the rear cavity that is not occupied by loudspeaker 204 components, e.g., voicecoil 212, frame 210, and magnetic assembly 214. Sound generated by the movement of diaphragm 206 propagates through back volume 216, and thus, the size of back volume 216 may influence acoustic performance. Generally speaking, increasing the size of back volume 216, i.e., increasing the spatial volume occupied by air in back volume 216, may result in the generation of louder bass sounds by audio speaker 106.

Acoustic performance of audio speaker 106 may also be influenced by an adsorptive insert 220 located within back volume 216. Adsorptive insert 220 may include adsorptive materials capable of adsorbing constituent molecules of a gas, e.g., air, located in back volume 216. For example, adsorptive insert 220 may include zeolite, activated carbon, silica, alumina, etc., having a porous structure that accommodates, i.e., adsorbs/desorbs, air molecules. Adsorption (and desorption) of air molecules by the adsorptive material in adsorptive insert 220 can influence pressure changes within back volume 216 and hence increase the effective back volume 216. That is, the adsorption/desorption can cause audio speaker 106 to operate as though it includes a larger back volume 216 than it actually has.

In an embodiment, adsorptive insert 220 includes an open-pore body 222 formed from the adsorptive materials. For example, the adsorptive materials may be bonded together to form a monolithic open-pore structure. The adsorptive materials may include beads, powders, etc. in a raw form. The raw adsorptive particle may then be processed as described below to fix the relative position of the adsorptive material constituents into a single agglomerated mass, e.g., a brick. The agglomerated body includes an outer surface 224 surrounding a spatial volume. Here, the term "agglomerated" is not used to merely describe the aggregation or agglomeration of several particles into a small grain structure, but rather, in an embodiment, the spatial volume occupied by open-pore body 222 is on a same order of magnitude, i.e., at least 10% of, the spatial volume occupied by back volume 216. Thus, open-pore body 222 of adsorptive insert 220 may be a monolithic mass composed of adsorptive materials that do not shift relative to each other during use. Such a structure may be contrasted with a bag of loosely packed adsorptive grains in which each grain is formed from aggregated adsorptive powders.

In addition to being a monolithic structure, open-pore body 222 may be rigid. In an embodiment, adsorptive materials bonded along outer surface 224 may be adjoined with one another such that outer surface 224 does not deform under external pressures, e.g., when knocked against frame 210 or magnetic assembly 214 if audio speaker 106 is dropped to the ground. More specifically, in an embodiment, only an outer shell region of open-pore body 222 is rigid. For example, adsorptive material making up an outer thickness, e.g., 2-5 mm, of open-pore body 222 may resist deformation while adsorptive material inward from the outer shell region, i.e., a core region, may be composed of loosely packed or weakly bonded adsorptive material that may not resist deformation and may shift relative to each other during an impact. In another embodiment, adsorptive materials throughout open-pore body 222, e.g., in the outer shell region and the core region, may be bonded such that the entire body is rigid and resistant to deformation during an impact. Thus, at least an outer surface 224 of open-pore body 222 may be considered to be solid in the sense that a portion of open-pore body 222 may be hard, compact, and not loosely packed. The term "solid," however, is not intended to exclude the porous structures described below.

The solid portions of open-pore body 222 may be shaped to conform to inner surface 218 of speaker housing 202. For example, speaker housing 202 may have corners (as in the case of a polyhedral inner surface 218 shape) or curvatures (as in the case of a curved inner surface 218 shape), and outer surface 224 of open-pore body 222 may include corresponding portions that are similar or identical in shape to the corners or curvatures of inner surface 218. Furthermore, in addition to being shaped to conform to inner surface 218 of speaker housing 202, open-pore body 222 may be shaped to conform to other components of audio speaker 106. For example, open-pore body 222 may include a loudspeaker receptacle 226, which may be a recess in a portion of outer surface 224 facing loudspeaker 204. Loudspeaker receptacle 226 may be sized to receive a portion of loudspeaker 204, e.g., a lower portion of magnetic assembly 214. Thus, the outer shape of open-pore body 222 may be modified to efficiently and/or maximally utilize the available space of back volume 216.

Open-pore body 222 may be spaced apart from inner surface 218 of speaker housing 202 to maximally expose outer surface 224 to air within back volume 216. For example, the entirety of outer surface 224 may be separated from inner surface 218 by a gap that may be consistent, or may vary, along outer surface 224. In the case of a varying gap distance, a portion of outer surface 224 on a top surface of open-pore body 222 may be farther from a top wall 230 of speaker housing 202 adjacent to speaker port 205, than a portion of outer surface 224 on a bottom surface of open-pore body 222 is from a bottom wall 232 of speaker housing 202. By contrast, the distance between all side portions of outer surface 224 may be equidistant from opposing side wall 234 portions of inner surface 218. In an embodiment, portions of outer surface 224 and inner surface 218 that are in an opposing and spaced apart relationship are separated by a distance at least equal to the mean free path of air molecules at standard atmospheric pressure, and may be at least 500 micron.

Portions of outer surface 224 and inner surface 218 that are in a spaced apart relationship may nonetheless be connected through an intermediate spacer. More particularly, one or more spacers, such as an open-cell spacer 228, may be used to separate open-pore body 222 from inner surface 218 and/or loudspeaker 204. Open-cell spacer 228 is one embodiment of a spacer, but it is not intended to be limiting. For example, dabs of adhesive may be located between open-pore body 222 and speaker housing 202 at discrete locations to attach outer surface 224 to inner surface 218. The adhesive spacers may maintain the spaced apart relationship over a distance equal to an adhesive film thickness. Alternatively, structures such as felt or foam spacers may be used to separate open-pore body 222 from speaker housing 202.

In an embodiment, the spacers are located between open-pore body 222 and inner surface 218 on one or more surfaces of open-pore body 222. For example, at least two spacers may be placed on different side portions of outer surface 224 such that the spacers resist motion in opposite directions, e.g., a spacer on a left side portion of open-pore body 222 may be squeezed when open-pore body 222 accelerates to the right and a spacer on a right side portion of open-pore body 222 may be squeezed when open-pore body 222 accelerates to the left. Similarly, opposing spacers may be located on top and bottom portions of outer surface 224.

In an embodiment, the spacers are permeable by air and allow air to move freely through them from back volume 216 to outer surface 224. Thus, portions of outer surface 224 that are in contact with spacer surfaces receive air from back volume 216 through the spacer for adsorption/desorption within the bonded adsorptive particles. As such, a spacer may cover a substantial portion of outer surface 224, e.g., may completely encompass open-pore body 222, without restricting the transfer of air molecules between back volume 216 and open-pore body 222. An open-cell spacer 228 is an embodiment of a spacer that facilitates air transfer between back volume 216 and open-pore body 222, and is described in more detail below.

Figure 3:
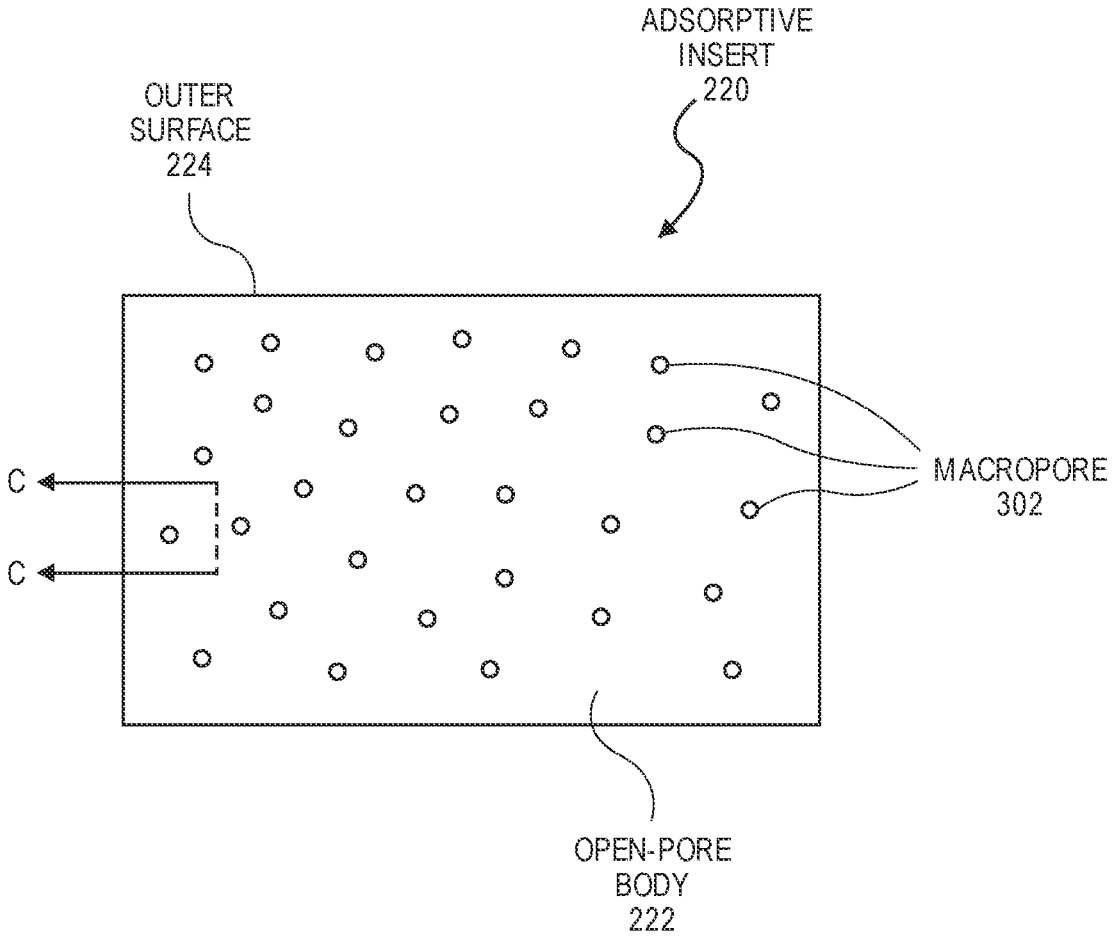
FIG. 3 is a cross-sectional view, taken about line A-A of FIG. 2, of an open-pore body of an adsorptive insert in accordance with an embodiment.

Referring to FIG. 3, a cross-sectional view, taken about line A-A of FIG. 2, of an open-pore body of an adsorptive insert is shown in accordance with an embodiment. Open-pore body 222 may be a monolithically formed rigid mass, as described above. Furthermore, outer surface 224 may be shaped such that the cross-sectional profile of open-pore body 222 is rectangular, to fit within a corresponding rear cavity portion, e.g., a rectangular cuboid cavity, a pyramidal cavity, etc., of speaker housing 202. In an embodiment, the spatial volume occupied by open-pore body 222 may be on a same order of magnitude as a spatial volume occupied by back volume 216. For example, open-pore body 222 may be sized to fill at least 10% of back volume 216. In an embodiment, open-pore body 222 may be sized to fill a majority of back volume 216. Accordingly, the spatial volume occupied by open-pore body 222 (a spatial volume surrounded by outer surface 224 and not accounting for a porosity or density of open-pore body 222 within the spatial volume envelope), may substantially fill the spatial volume occupied by back volume 216 (the spatial volume between the inner surface 218 of speaker housing 202 and loudspeaker 204). The ratio of the spatial volume of open-pore body 222 to the spatial volume of back volume 216 may be greater than 0.5 (50% fill), such as more than 0.75 (75% fill) or more than 0.90 (90% fill). In an embodiment, the ratio is less than 1.0 (100% fill) because outer surface 224 and inner surface 218 are spaced apart from each other.

The constituent adsorptive material of open-pore body 222 may be adsorptive particles, and more particularly, thousands to millions of adsorptive particles bound together to form a rigid, monolithic structure. Because the adsorptive particles may be bound together using one or more of the processing techniques described below, the density of open-pore body 222 may be greater than the density of the constituent adsorptive particles if they were loosely packed together. For example, whereas if open-pore body 222 were formed from loosely packed adsorptive particles that were not bonded together, the density of open-pore body 222 would be expected to be less than 40%, it is contemplated that open-pore body 222 formed from bonded adsorptive particles may include a rigid structure in which the bonded adsorptive particles occupy at least 40% of the spatial volume surrounded by outer surface 224. More particularly, open-pore body 222 may include a porous structure having macropores 302 along outer surface 224 and between the bonded adsorptive particles, but the macropores 302 may occupy less than 60% of the spatial volume, such that the bonded adsorptive particles occupy more than 40%, and optionally a majority, of the spatial volume surrounded by outer surface 224.

Open-pore body 222 may be considered "open-pored" because the macropores 302 between bonded adsorptive particles are interconnected throughout the rigid body. That is, the macropores 302, which are represented as circular holes in the cross-sectional view of FIG. 3, but which in fact may be voids of any shape, may be interconnected in a three-dimensional network of passages that allow for air to flow from one macropore 302 to another. As such, macropores 302 may instead be conceptualized as interstitial spaces, or interstices having varying geometries, that separate one adsorptive particle from one or more other adjacent adsorptive particles in the rigidly-bound structure of open-pore body 222. Accordingly, at a macroscopic level, a cross-section of open-pore body 222 having a uniform porosity may include bonded adsorptive particles occupying at least 50% of the cross-sectional area and macropores 302 occupying no more than 50% of the cross-sectional area.

Figure 4:
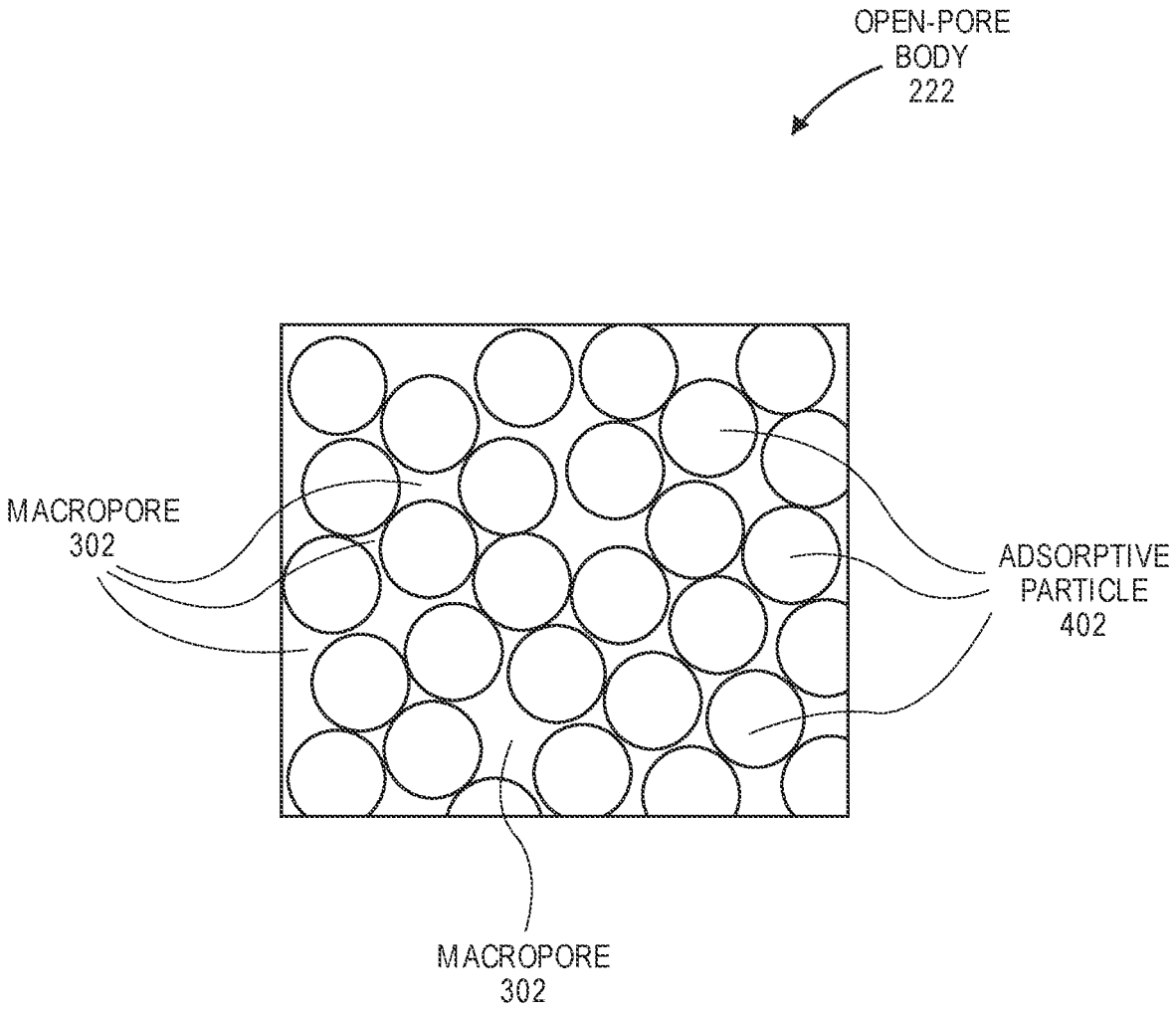
FIG. 4 is a cross-sectional view, taken about line C-C of FIG. 3, of bonded adsorptive particles of an open-pore body of an adsorptive insert in accordance with an embodiment.

Referring to FIG. 4, a cross-sectional view, taken about line C-C of FIG. 3, of bonded adsorptive particles of an open-pore body of an adsorptive insert is shown in accordance with an embodiment. The average diameter or dimension across a macropore 302 between adjacent adsorptive particles 402 may be at least equal to the mean free path of air molecules at standard atmospheric pressure. For example, the average dimension may be at least 75 nm. Open-pore body 222 may include macropores 302 having an average pore dimension, however, on the order of tens of microns, e.g., 10 microns, up to on the order of hundreds of microns, e.g., 500 microns. In an embodiment, the pore dimension is uniform within a tolerance of an order of magnitude throughout the cross-section of open-pore body 222. For example, the pore dimensions may be in a range of 10 to 50 microns throughout the cross-section. Accordingly, macropores 302 distributed along outer surface 224 and throughout open-pore body 222 provide a network of passages through which air may be transported by pressure waves during sound generation. More particularly, air may be transported from back volume 216 surrounding outer surface 224 into open-pore body 222 through macropores 302 along outer surface 224. After entering open-pore body 222, the air may further circulate or travel through the interconnected macropores 302 to the surfaces of bonded adsorptive particles 402, where the air molecules may then be adsorbed/desorbed by adsorptive particles 402.

Figure 5:
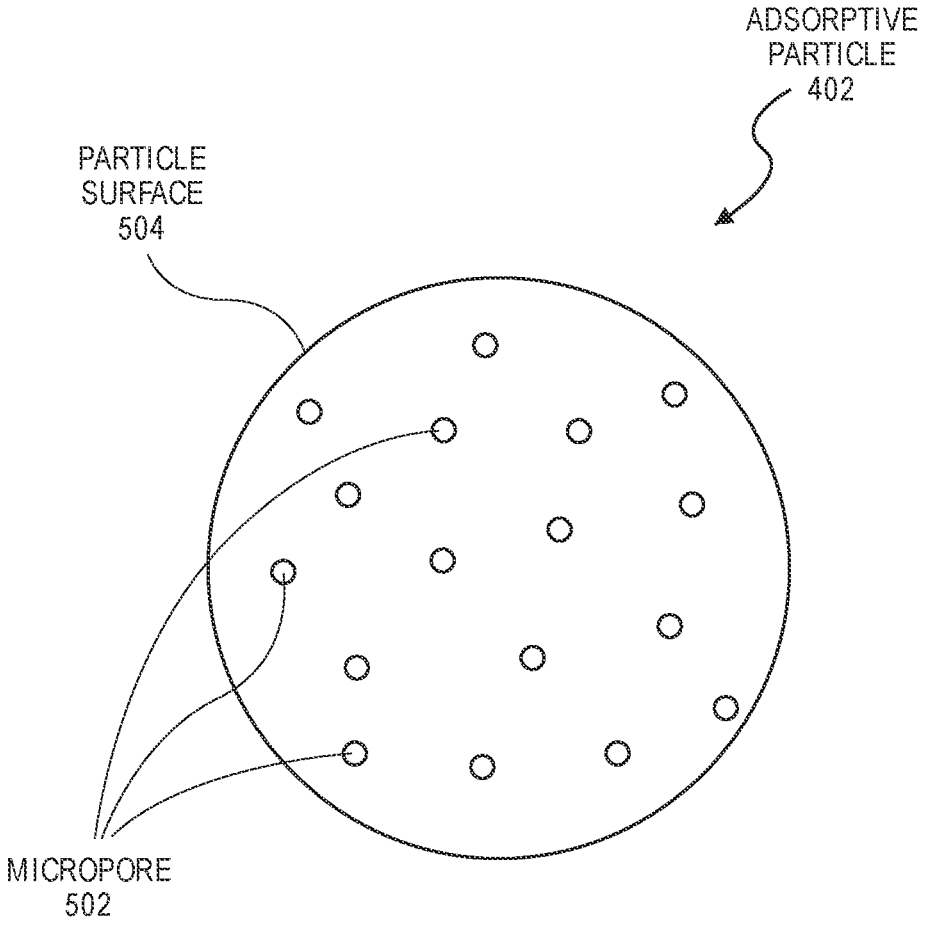
FIG. 5 is a side view of an adsorptive particle in accordance with an embodiment.

Referring to FIG. 5, a side view of an adsorptive particle is shown in accordance with an embodiment. Adsorption/desorption of air molecules by bonded adsorptive particles 402 occurs based on micropores 502 within adsorptive particle 402. Similar to the macroscopic structure of open-pore body 222, which includes outer surface 224 surrounding a spatial volume and macropores 302 along outer surface 224 and within the spatial volume, each adsorptive particle 402 may include a particle surface 504 surrounding a particle spatial volume and micropores 502 along the particle surface 504 and within the particle spatial volume. Adsorptive particle surface 504 may be spherical (as shown) or may have any other surface morphology. Accordingly, adsorptive particle 402 includes a porous structure with micropores 502 suited to adsorb and desorb the constituent molecules of air, e.g., nitrogen, oxygen, carbon dioxide, etc. As discussed above, numerous adsorptive materials are known for this purpose, including zeolite, activated carbon, and other molecular sieve materials. Adsorptive particles 402 formed from such materials are contemplated to be within the scope of this disclosure. For example, in an embodiment, bonded adsorptive particles 402 include zeolites having micropores 502 with pore dimensions, i.e., average pore diameters, in a range of 2-10 angstroms. Accordingly, micropores 502 may adsorb/desorb constituent molecules of air transported to particle surfaces 504 during sound generation to alter the frequency of the natural resonance peak of audio speaker 106.

Figure 6:
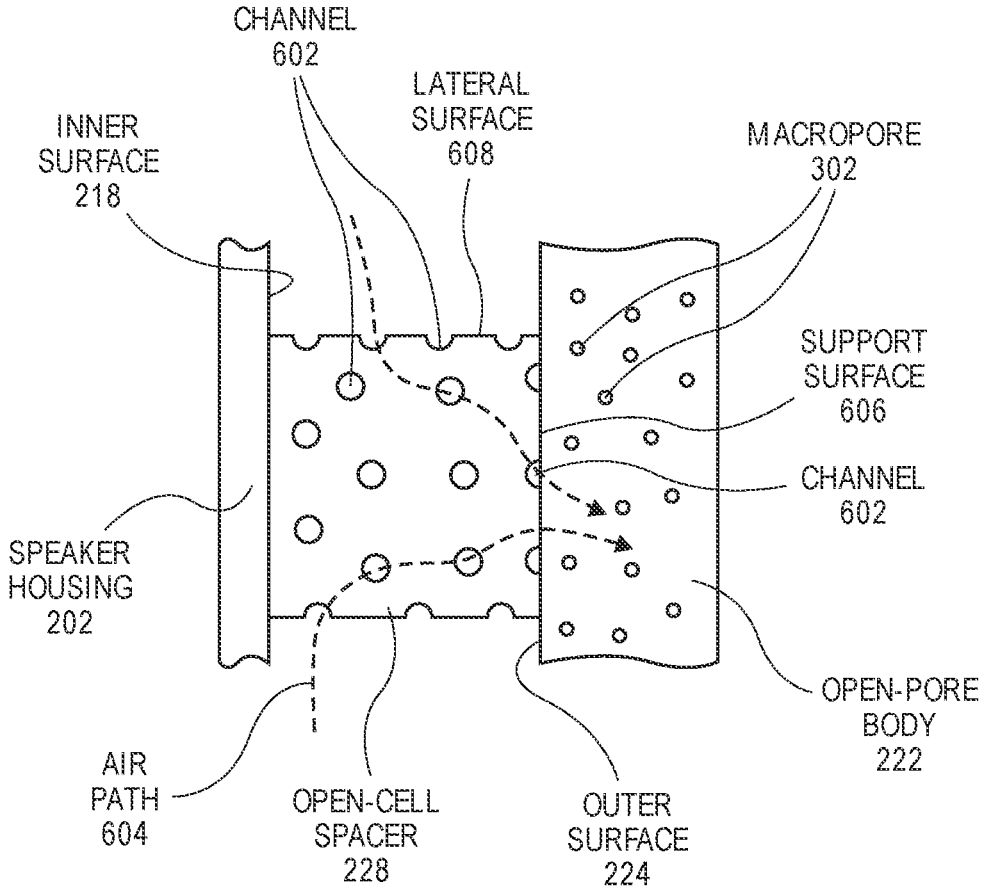
FIG. 6 is a cross-sectional view, taken about line B-B of FIG. 2, of an open-cell spacer between a speaker housing and an open-pore body of an adsorptive insert in accordance with an embodiment.

Referring to FIG. 6, a cross-sectional view, taken about line B-B of FIG. 2, of an open-cell spacer between a speaker housing and an open-pore body of an adsorptive insert is shown in accordance with an embodiment. One or more open-cell spacer 228 may separate outer surface 224 of open-pore body 222 from inner surface 218 of speaker housing 202. Open-cell spacer 228 may have a thickness between inner surface 218 and outer surface 224 that is at least twice an average diameter of the pores within open-cell spacer 228. For example, open-cell spacer 228 may be formed from an open-cell foam, e.g., a reticulated foam of polyurethane, ceramic, or metal, with several interconnected pores forming channels 602 that provide an air path 604 from back volume 216 to outer surface 224. In an embodiment, the interconnected pores may have an average diameter of 100 micron, and accordingly, the thickness of open-cell spacer 228 and the distance between outer surface 224 and inner surface 218 may be at least 200 microns, such as 500 microns or more.

The interconnected pores of open-cell spacer 228 may form channels 602 to create routes of air ingress and egress along every side of open-cell spacer 228. More particularly, open-cell spacer 228 may include channels 602 that interconnect at least one side exposed to back volume 216 to another side opposing macropores 302 along outer surface 224. In an embodiment, open-cell spacer 228 is a rectangular cuboid block of open-cell foam having a surface pressed against speaker housing 202 in a rearward direction, a support surface 606 opposing and pressed against outer surface 224 in a frontward direction, and four lateral surfaces 608 exposed to air within back volume 216 between speaker housing 202 and open-pore body 222. Support surface 606 and lateral surfaces 608 may be porous, in that each surface may include a terminal end of at least one of several pores or channels 602 that are interconnected across open-cell spacer 228 to create air path 604 from lateral surface 608 to support surface 606. More particularly, lateral surfaces 608 may not act as barriers to air flow in a lateral direction between speaker housing 202 and outer surface 224, but may instead be air permeable, allowing air to flow laterally from one lateral surface 608 to another lateral surface 608. Accordingly, the porous surfaces of lateral surface 608 and support surface 606 may be in fluid communication through channels 602 to transport air from back volume 216 to macropores 302 along outer surface 224, and into the macroscopic network of passages in open-pore body 222.

Figure 7:
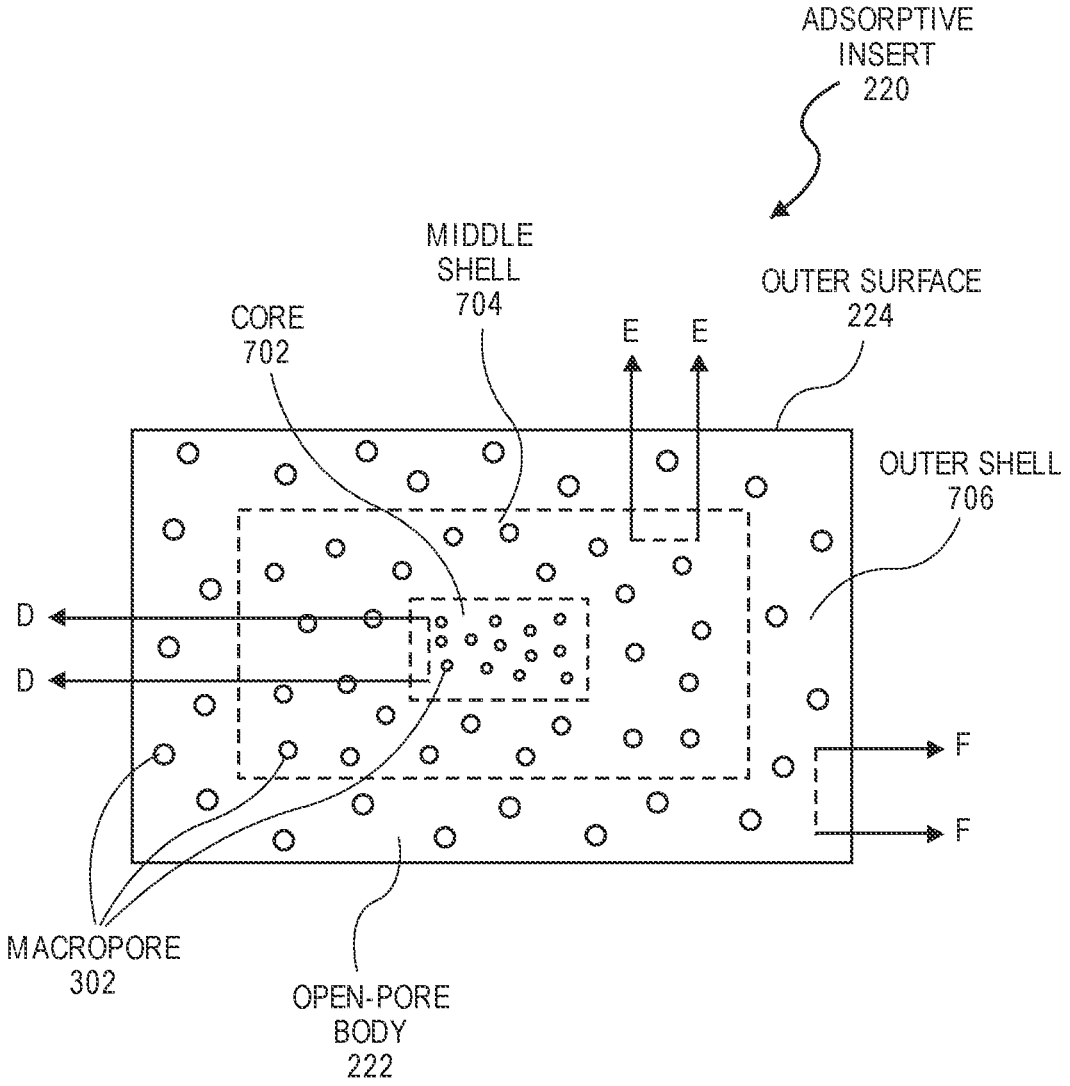
FIG. 7 is a cross-sectional view, taken about line A-A of FIG. 2, of a hierarchical open-pore body of an adsorptive insert in accordance with an embodiment.

Referring to FIG. 7, a cross-sectional view, taken about line A-A of FIG. 2, of a hierarchical open-pore body of an adsorptive insert is shown in accordance with an embodiment. In an embodiment, adsorptive particles 402 of open-pore body 222 are bonded to form a rigid, tiered structure. For example, rather than having a substantially uniform porosity throughout open-pore body 222, adsorptive insert 220 may include open-pore body 222 having macropores 302 that vary in size between a central core 702 region and one or more shell regions surrounding the core 702 region. For example, open-pore body 222 may have a three-level hierarchical structure with core 702 region surrounded by a middle shell 704, and an outer shell 706 surrounding middle shell 704. The porosity of open-pore body 222 may vary between one or more of core 702, middle shell 704, and outer shell 706. For example, macropores 302 along outer surface 224 on outer shell 706 may be larger, on average, than macropores 302 at a center of open-pore body 222 in core 702. Similarly, macropores 302 in middle shell 704 may be smaller, on average, than macropores 302 in outer shell 706, and larger, on average, than macropores 302 in core 702. As in the embodiments of open-pore body 222 described above, an open-pore body 222 having a hierarchical structure may allow for air to be transported from back volume 216 through the interconnected macropores 302 of open-pore body 222 from outer surface 224 into micropores 502 in the bonded adsorptive particles 402 of the outer shell 706 region, middle shell 704 region, and core 702 region.

Figure 8:
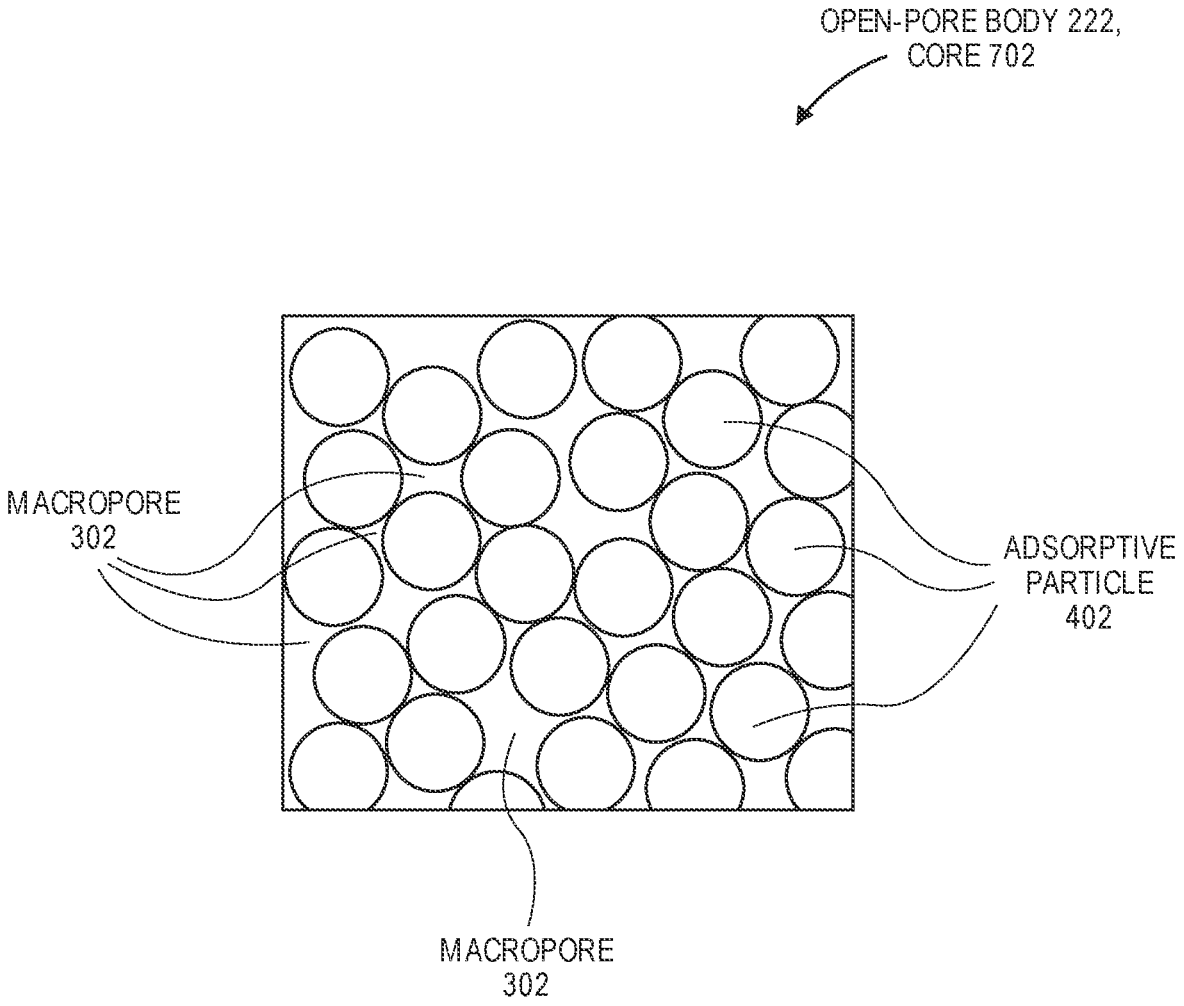
FIG. 8 is a cross-sectional view, taken about line D-D of FIG. 7, of a core of a hierarchical open-pore body of an adsorptive insert in accordance with an embodiment.

Referring to FIG. 8, a cross-sectional view, taken about line D-D of FIG. 7, of a core of a hierarchical open-pore body of an adsorptive insert is shown in accordance with an embodiment. Core 702 region of open-pore body 222 may include adsorptive particles 402 bonded together and separated by intervening macropores 302, as described above. In an embodiment, the porosity of core 702 region and the average dimension of macropores 302 may be similar to the values described with respect to FIG. 4. For example, the average pore dimension of macropores 302 may be in a range of 10 to 50 microns throughout the cross-section of core 702, and macropores 302 may occupy less than 60% of a spatial volume occupied by core 702 region, i.e., a core volume. In an embodiment, bonded adsorptive particles 402 may be at least twice as dense as would be the case if the adsorptive particles 402 were loosely packed. Thus, macropores 302 may occupy less than 30% of the core volume, e.g., macropores 302 may occupy between 10-20% of the core volume.

Figure 9:
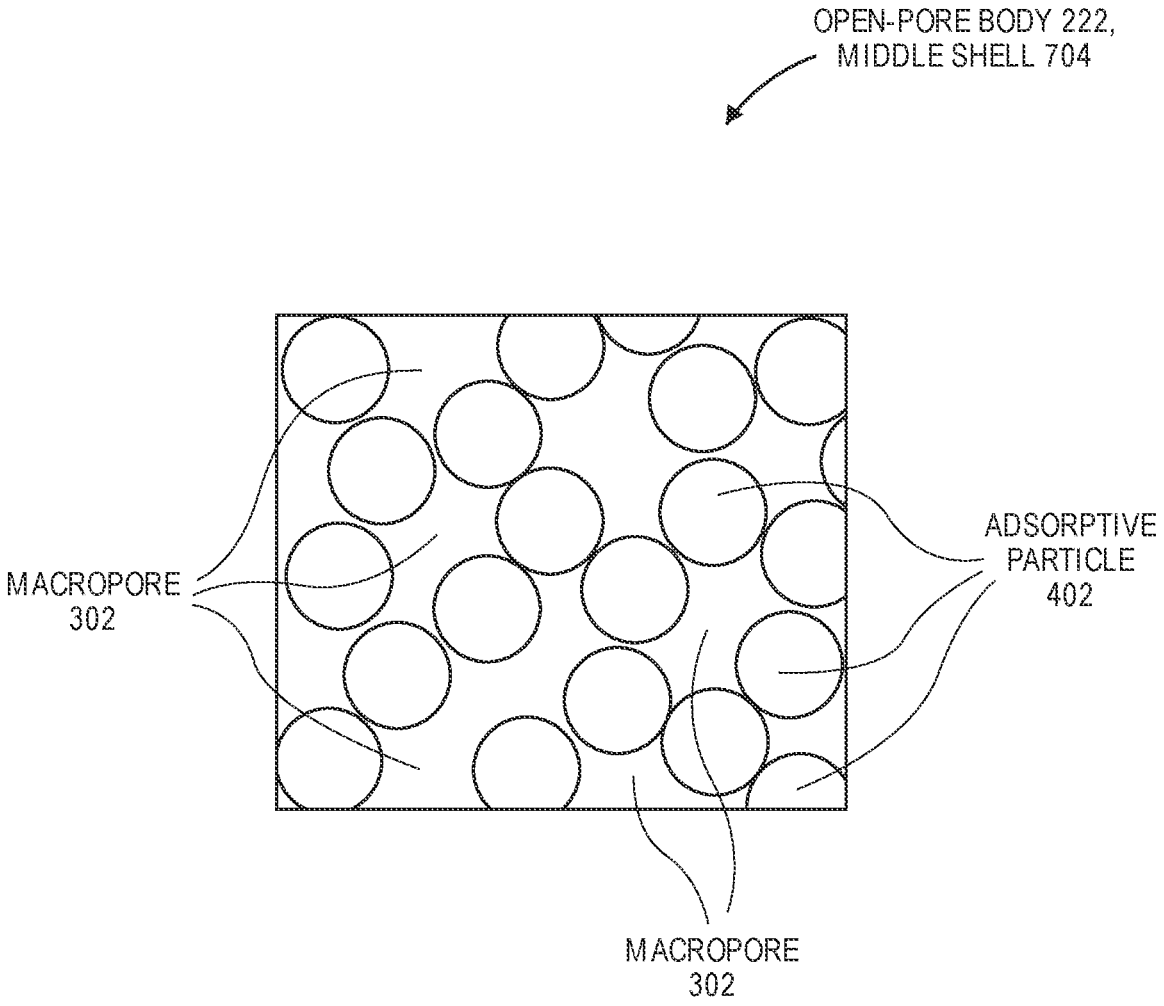
FIG. 9 is a cross-sectional view, taken about line E-E of FIG. 7, of a middle shell of a hierarchical open-pore body of an adsorptive insert in accordance with an embodiment.

Referring to FIG. 9, a cross-sectional view, taken about line E-E of FIG. 7, of a middle shell of a hierarchical open-pore body of an adsorptive insert is shown in accordance with an embodiment. Middle shell 704 region of open-pore body 222 may include several adsorptive particles 402 bonded together and separated by intervening macropores 302 with average separation distances higher than those of core 702 region. In an embodiment, the average dimension of macropores 302 may be at least twice the corresponding values of core 702 region. For example, when core 702 region includes an average macropore 302 dimension in a range of 10 to 50 microns, middle shell 704 region may include an average macropore 302 dimension in a range of 20 to 100 microns. Similarly, a porosity of middle shell 704 region may be greater than a porosity of core 702 region. For example, when macropores 302 of core 702 region occupy less than 30% of the core volume, macropores 302 of middle shell 704 may occupy more than 30%, e.g., 30-50%, of a spatial volume occupied by middle shell 704, i.e., a middle shell volume.

Figure 10:
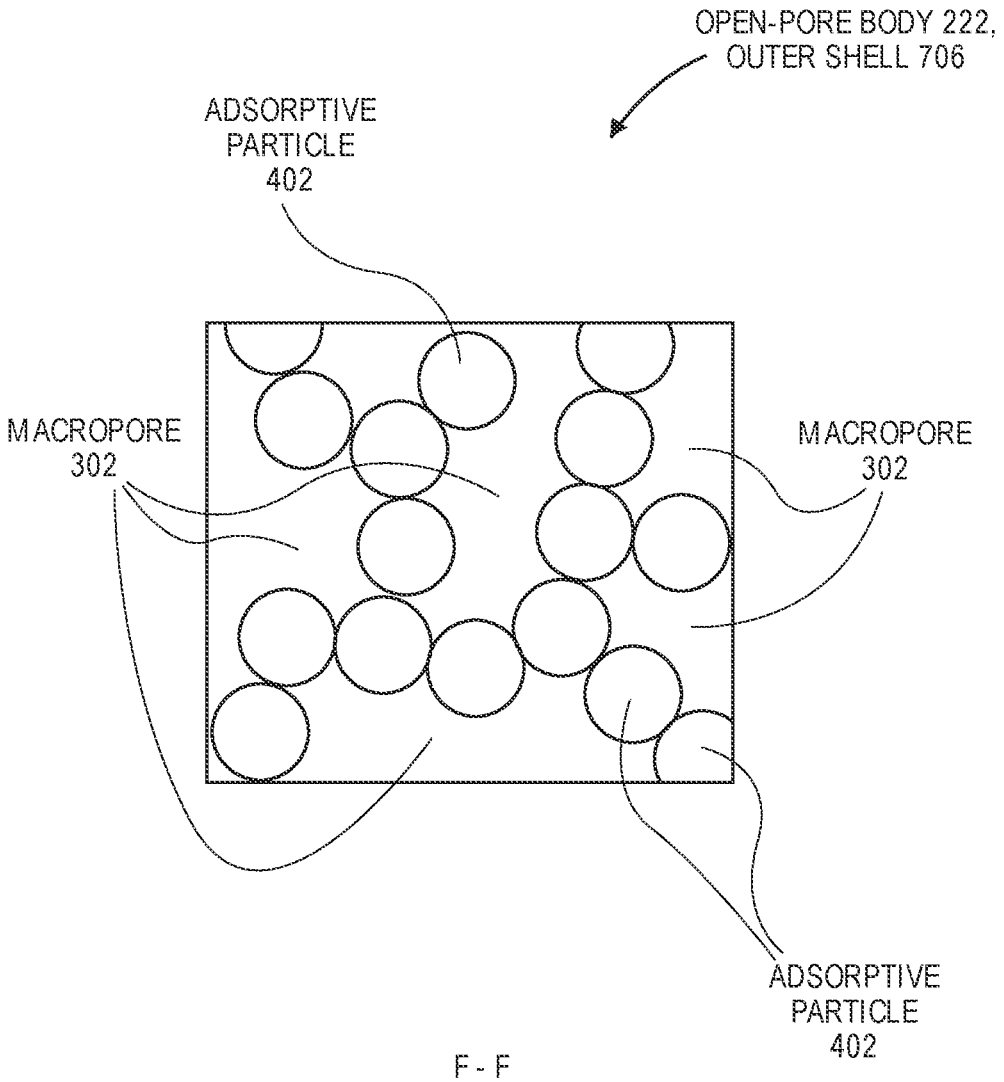
FIG. 10 is a cross-sectional view, taken about line F-F of FIG. 7, of an outer shell of a hierarchical open-pore body of an adsorptive insert in accordance with an embodiment.

Referring to FIG. 10, a cross-sectional view, taken about line F-F of FIG. 7, of an outer shell of a hierarchical open-pore body of an adsorptive insert is shown in accordance with an embodiment. Outer shell 706 region of open-pore body 222 may include several adsorptive particles 402 bonded together and separated by intervening macropores 302 with average separation distances higher than those of middle shell 704 region. In an embodiment, the average dimension of macropores 302 may be larger than the corresponding values of middle shell 704 region. Furthermore, the average dimension of macropores 302 in outer shell 706 region may be at least an order of magnitude larger than macropores 302 in the core 702 region. For example, when core 702 region includes an average macropore 302 dimension in a range of 10 to 50 microns and middle shell 704 region includes an average macropore 302 dimension in a range of 20 to 100 microns, outer shell 706 region may include an average macropore 302 dimension in a range 100 to 500 microns. Similarly, a porosity of outer shell 706 region may be greater than a porosity of both core 702 region and middle shell 704 region, but less than a porosity associated with loosely packed adsorptive particles 402, e.g., less than 60%. For example, when macropores 302 of core 702 region occupy less than 30% of the core volume, and macropores 302 of middle shell 704 occupy more than 30%, e.g., 30-50%, of the middle shell volume, macropores 302 of outer shell 706 may occupy between 50-60% of the outer shell volume.

The value of porosity and average pore dimension of various shells are provided above by way of example, but those values and the shell configuration may vary. For example, in an embodiment, open-pore body 222 may include only two regions, e.g., core 702 and outer shell 706 regions, or may include more than three regions, e.g., may have more than two shell regions. Accordingly, the configuration of open-pore body 222 may be altered within the scope of the description to provide a porous structure having pores that decrease in size (on average) from outer surface 224 toward a center such that air transported from back volume 216 into open-pore body 222 is funneled into smaller and smaller passages within the network of interconnected macropores 302.

Figure 11:
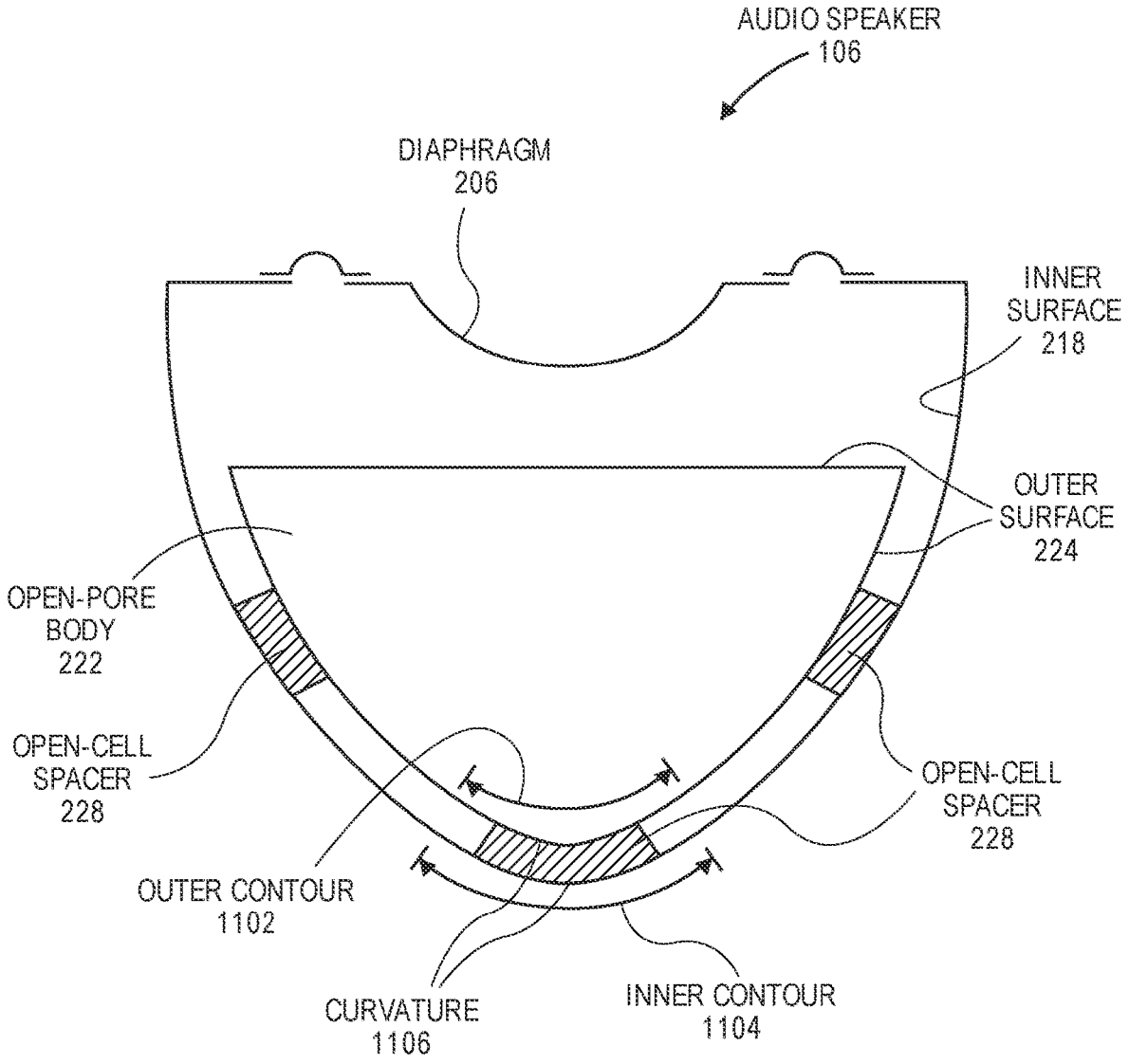
FIG. 11 is a sectional view of an audio speaker having an adsorptive insert and speaker housing with conforming curved contours in accordance with an embodiment.

Referring to FIG. 11, a sectional view of an audio speaker having an adsorptive insert and speaker housing with conforming curved contours is shown in accordance with an embodiment. As described above, all of outer surface 224 of open-pore body 222 may be spaced apart from inner surface 218 of speaker housing 202. For example, open-cell spacers 228 may be located between opposing portions of inner surface 218 and outer surface 224 to maintain speaker housing 202 and open-pore body 222 in a spaced apart relationship. In addition to being spaced apart from each other, all or part of outer surface 224 may conform to opposing portions of inner surface 218. For example, outer surface 224 may include one or more outer contour 1102 opposing corresponding inner contour(s) 1104 of inner surface 218. Outer contour 1102 and inner contour 1104 may be conforming. That is, a shape of outer surface 224 along outer contour 1102 may essentially be a negative of a shape of inner surface 218 along inner contour 1104. Accordingly, outer surface 224 may include a curvature 1106 along outer contour 1102 having a radius of curvature that is similar or identical to a radius of curvature of a corresponding curvature 1106 along inner contour 1104 of inner surface 218. Thus, outer contour 1102 may conform with inner contour 1104, and the curved surfaces may be spaced apart from each other by an intervening spacer.

Figure 12:
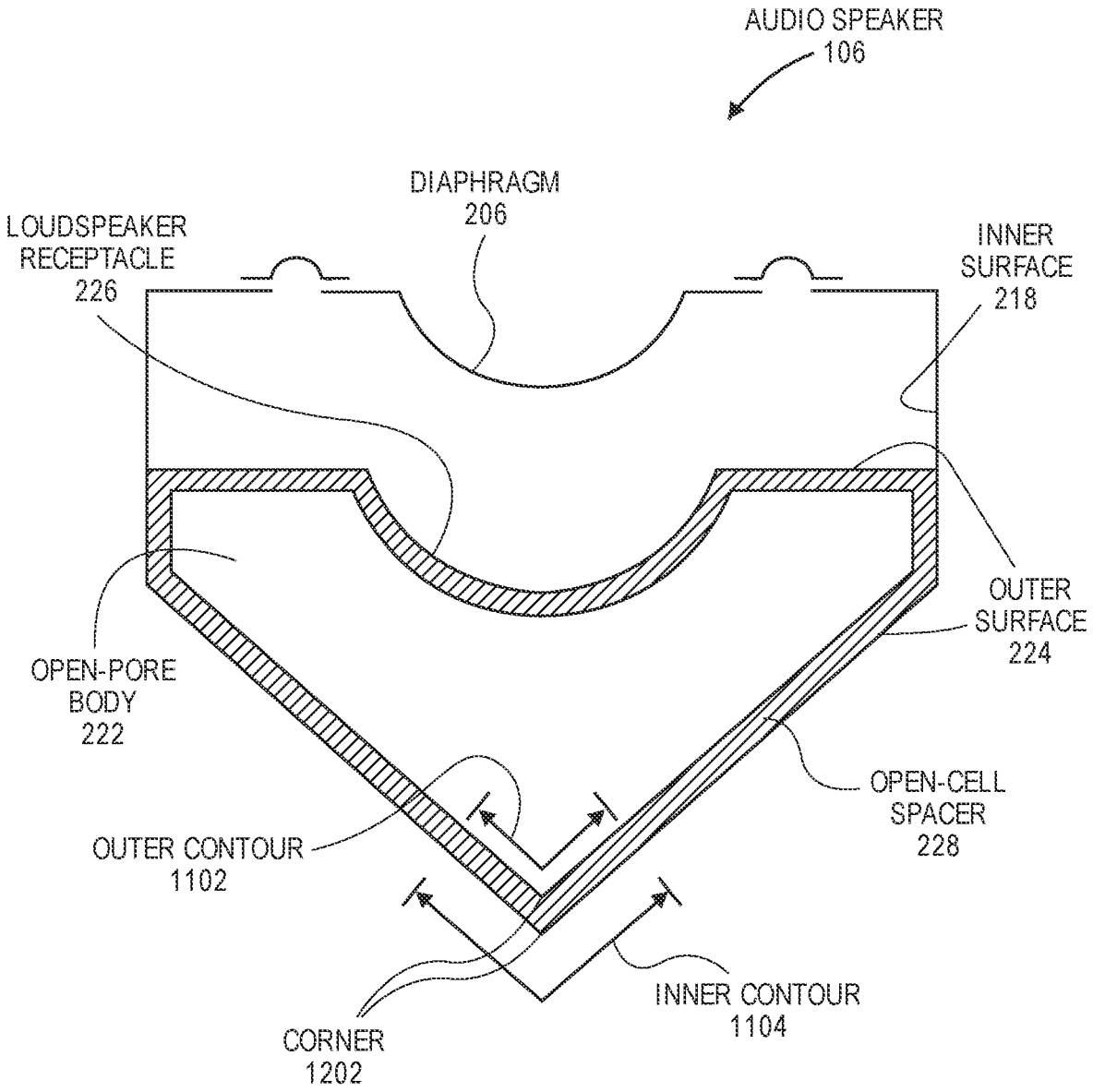
FIG. 12 is a sectional view of an audio speaker having an adsorptive insert and speaker housing with conforming angular contours in accordance with an embodiment.

Referring to FIG. 12, a sectional view of an audio speaker having an adsorptive insert and speaker housing with conforming angular contours is shown in accordance with an embodiment. Open-pore body 222 may be entirely surrounded by open-cell spacer 228, and thus, the entirety of outer surface 224 may be in a spaced apart relationship with inner surface 218. In addition to separating open-pore body 222 from inner surface 218, open-cell spacer 228 may permit ingress/egress of air from back volume 216. Additionally, the spacer may provide cushioning or shock absorption between open-pore body 222 and other structures. For example, open-cell spacer 228 may extend over loudspeaker receptacle 226 that conforms with loudspeaker (not shown) and can absorb mechanical impacts from loudspeaker 204 in the event that audio speaker 106 is dropped or otherwise jolted. Thus, open-pore body 222 may be shaped to closely conform with inner surface 218, as well as other surfaces of audio speaker components, while being cushioned from impacts therewith by open-cell spacers 228.

Still referring to FIG. 12, the conforming contours need not be curves (as in the case of curvature 1106 shown in FIG. 11 and loudspeaker receptacle 226 shown in FIG. 12), but may be angular. For example, outer surface 224 may include a corner 1202 along outer contour 1102 having one or more angles (as in the case of a pyramidal corner) and the corner may be similar or identical to an angular configuration of a corresponding corner 1202 along inner contour 1104 of inner surface 218. Accordingly, outer contour 1102 may conform to inner contour 1104, and the contours may be curved, angular, or otherwise-shaped surfaces that are spaced apart from each other by an intervening spacer.

Figure 13:
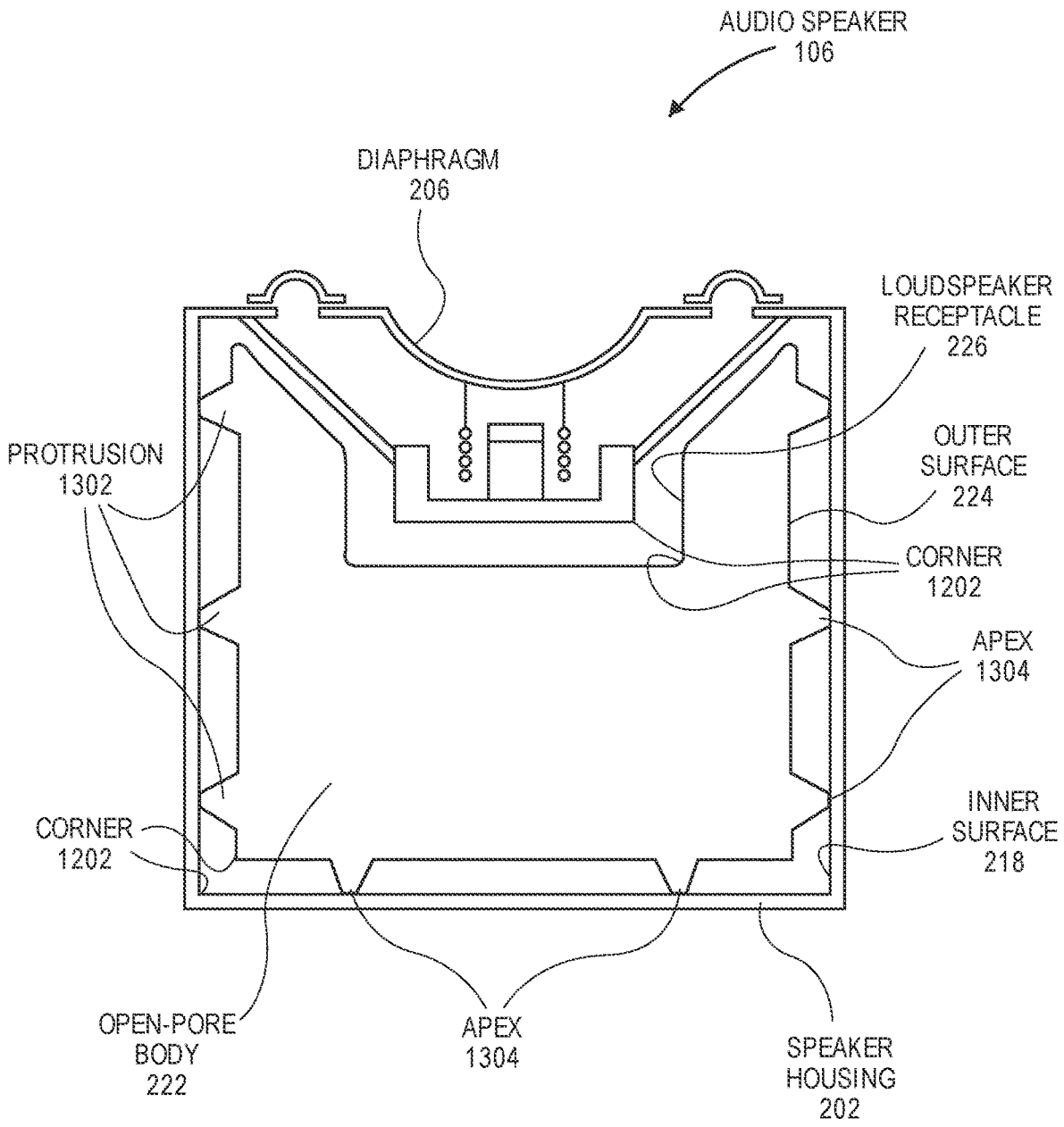
FIG. 13 is a sectional view of an audio speaker having an adsorptive insert with protrusions to space apart an open-pore body from a speaker housing in accordance with an embodiment.

Referring to FIG. 13, a sectional view of an audio speaker having an adsorptive insert with protrusions to space apart an open-pore body from a speaker housing is shown in accordance with an embodiment. In an embodiment, substantially all (but not the entirety) of outer surface 224 of open-pore body 222 is spaced apart from inner surface 218 of speaker housing 202. More particularly, adsorptive insert 220 may include one or more protrusions 1302 extending from a surrounding portion of outer surface 224 to contact inner surface 218 and thereby maintain the surrounding portion of outer surface 224 in a spaced apart relationship with inner surface 218. Protrusions 1302 may be formed by removing material of open-pore body 222 around protrusions 1302 to a level of the surrounding portion of outer surface 224. Alternatively, protrusions 1302 may be separately formed porous structures that are adhered or otherwise attached to outer surface 224. In any case, protrusions 1302 may include respective apices that are disposed against inner surface 218. For example, protrusion 1302 may include a conical structure extending from a base at a surrounding portion of outer surface 224 and terminating in an apex 1304, e.g., a pointed or flattened region of protrusion 1302. Apex 1304 may include a surface area that is substantially less than the entire surface area of outer surface 224. In an embodiment, a surface area of each apex 1304 may be less than 1% of the entire surface area of outer surface 224 to ensure that no more than 10% of outer surface 224 (including apex 1304 surface area) is pressed against inner surface 218. As such, at least 90% of outer surface 224 of open-pore body 222 may be exposed to back volume 216 to allow air to migrate through macropores 302 along outer surface 224 into the macroscopic network of open-pore body 222. As described above, open-pore body 222 having protrusions 1302 that act as spacers between outer surface 224 and inner surface 218 may also occupy a majority of back volume 216, and include contours (such as corners 1202) that conform to opposing contours of speaker housing 202 or loudspeaker 204.

Figure 14:
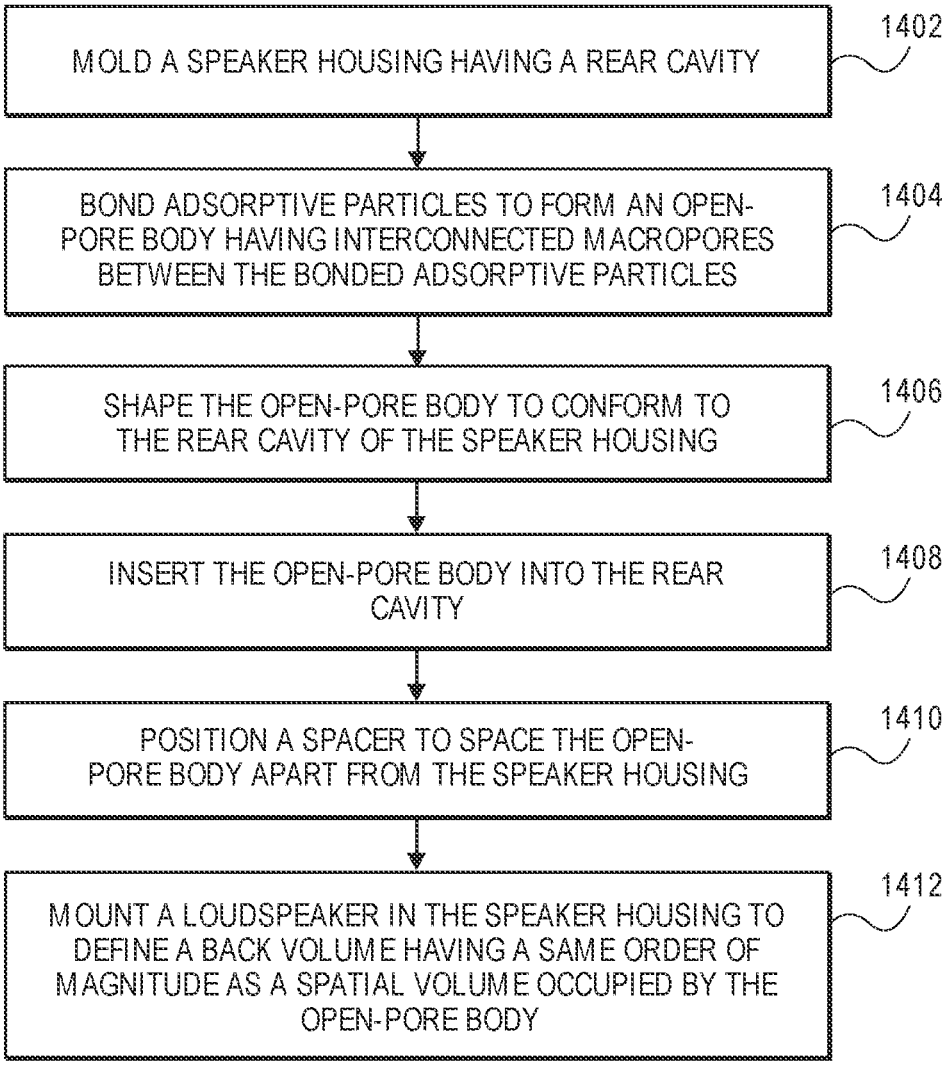
FIG. 14 is a flowchart of a method of forming an audio speaker having an adsorptive insert within a speaker housing in accordance with an embodiment.

Referring to FIG. 14, a flowchart of a method of forming an audio speaker having an adsorptive insert within a speaker housing is shown in accordance with an embodiment. At operation 1402, speaker housing 202 may be formed, e.g., in a plastic or metal molding process, to include speaker port 205 and inner surface 218. A rear cavity may be defined within inner surface 218 when speaker housing 202 is in an assembled condition. For example, speaker housing 202 may include multiple components, e.g., two halves, which are joined together along corresponding edges using adhesives, welding, or other processes to form speaker housing 202 and enclose the rear cavity.

At operation 1404, open-pore body 222 may be formed from adsorptive particles 402. Adsorptive particles 402 may be bound together into a rigid monolithic structure. As described below, adsorptive particles 402 may be bonded using several processing techniques. For example, compaction, sintering, spark plasma sintering, extrusion, and scaffolding techniques may be used to transform loose adsorbent particles, e.g., in powder form, into open-pore body 222. Several of the described processing techniques include methods of applying heat or pressure to the adsorptive particles 402 to bond the particles into a monolith having interconnected macropores 302 that occupy less than 60% of a spatial volume occupied by open-pore body 222. Furthermore, the bonded adsorptive particles 402 may occupy a majority of the spatial volume. Accordingly, a rigid structure may be formed from adsorptive particles 402 and have a macroscopic porosity that is less than a porosity, on a per unit volume basis, of the adsorptive particles 402 if they were loosely packed.

At operation 1406, the monolithically formed open-pore body 222 is, optionally, shaped with secondary processing techniques. For example, adsorptive particles 402 along outer surface 224 may be removed using known machining techniques, e.g., mechanical milling, laser cutting, or electrical discharge machining, to shape a portion of outer surface 224 into outer contour 1102 that has a same shape, or conforms with, an inner contour 1104 of a portion of inner surface 218. Shaping of the monolithically formed open-pore body 222 may be achieved in other manners, including stamping, grinding, etc. Thus, open-pore body 222 formed by binding adsorptive particles 402 together may be subsequently shaped to achieve a predetermined shape, which optionally conforms to a shape of the rear cavity of speaker housing 202.

At operation 1408, the open-pore body 222 having the desired shape is inserted into the rear cavity of speaker housing 202. Insertion may be through speaker port 205. Alternatively, speaker housing 202 may have multiple components, e.g., halves, which are assembled around adsorptive insert 220. For example, bottom wall 232 of speaker housing 202 opposite from speaker port 205 may be a cap such that open-pore body 222 may be inserted upward into rear cavity, and the bottom wall 232 cap may be glued or otherwise fastened to the mating side walls 234 of speaker housing 202 to seal open-pore body 222 within the rear cavity.

At operation 1410, one or more open-cell spacer 228 may be located between outer surface 224 of open-pore body 222 and inner surface 218 of speaker housing 202. Several spacers may be located along inner surface 218, e.g., by bonding a back surface opposite from support surface 606 to the inner surface 218 of speaker housing 202, prior to inserting open-pore body 222 into the rear cavity. Alternatively, a single open-cell spacer 228 may surround a portion of open-pore body 222, e.g., as in the case of a sleeve placed around all sides of open-pore body 222, or a pouch placed around the entirety of open-pore body 222, prior to inserting open-pore body 222 into the rear cavity. Accordingly, the assembled audio speaker may include porous surfaces of open-cell spacer 228 that are in fluid communication through interconnected pores or channels 602 to transport air in the rear cavity to macropores 302 along outer surface 224 of open-pore body 222. Furthermore, open-cell spacer(s) 228 may cushion and fasten open-pore body 222 in a spaced apart relationship with speaker housing 202.

At operation 1412, loudspeaker 204 is mounted in speaker port 205 to define back volume 216 between loudspeaker 204 and inner surface 218 of speaker housing 202. Thus, by fully enclosing the rear cavity, back volume 216 may be defined between loudspeaker 204 and inner surface 218, may encompass air and open-pore body 222. Accordingly, air within the defined back volume 216 may be exchanged with open-pore body 222 for adsorption/desorption by micropores 502 within the bonded adsorptive particles 402 during sound generation by loudspeaker 204.

Several processing techniques for bonding loose adsorptive particles 402 together into a rigid monolith, as used in operation 1404, are now described. In an embodiment, adsorptive particles 402 may be bound together to form a rigid open-pore body 222 using a compaction method. In the compaction method, the adsorptive particles 402 may be loaded into a die having a desired shape, e.g., a cubical shape having a rectangular cross-sectional profile slightly smaller than a rectangular cross-sectional profile of speaker housing 202. Inward pressure may then be applied to the adsorptive particles 402 through compression from the die to cause the particles to fuse together. Optionally, a chemical binder, e.g., a polymer, may be dispersed between the adsorptive particles 402 such that the pressure activates the binder to cause fusion of the adsorptive particles 402. Accordingly, the pressure-fused adsorptive particles 402 may form a monolithic rigid structure having a macroscopic porosity lower than the loose adsorptive particles 402.

In an embodiment, adsorptive particles 402 may be bound together to form a rigid open-pore body 222 using a sintering method that employs heat and pressure. For example, the adsorptive particles 402 may be compacted in a die of the desired shape to create a "green" material, which may be subsequently heated below the liquefaction point. As heat and inward pressure are applied over time, necks may form between the particles, causing the particles to become bonded and merged into a rigid structure. The sintering process may reduce the porosity, and increase the strength and rigidity, of the green material. Accordingly, a monolithically formed rigid open-pore body 222 having a macroscopic porosity less than the porosity of loosely packed adsorptive particles 402 may be formed.

A sintering process may also be used to form a hierarchical open-pore body 222. For example, a first die may be used to form core 702 region of open-pore body 222 having a first porosity, which depends on the heat and inward pressure applied. Subsequently, the rigid core 702 region may be loaded into a second die and additional adsorptive particles 402 may be loaded around core 702 region. The additional adsorptive particles 402 may have the same or different size, shape, or micropore porosity as the raw adsorptive particles 402 used to form core 702 region. A different heat and inward pressure may be used to sinter the second layer of material around the core 702 region to form a rigid middle shell 704 region. For example, lower pressures may be applied during the firing process to create a more porous middle shell 704 region. Subsequently, the rigid core 702 and middle shell 704 regions may be loaded into a third die and additional adsorptive particles 402 may be loaded around the middle shell 704. The additional adsorptive particles 402 may have the same or different size, shape, or micropore porosity as the raw adsorptive particles 402 used to form the core 702 and middle shell 704 regions. A different heat and inward pressure may be used to sinter the third layer of material around the core 702 and middle shell 704 regions to form a rigid outer shell 706. For example, lower temperatures may be applied during a shorter firing process to create a more porous outer shell 706 region. As described above, the differences in raw material sizes and porosity, as well as the differences in sintering process parameters, may result in a tiered structure that is monolithic in the sense that it can be stably handled as a single structure, but which may include a hierarchical macroscopic network to funnel air from larger diameter macropores 302 in the outer shell 706 region to smaller diameter macropores 302 in the core 702 region.

Other sintering techniques may be used to form one or more layers of a rigid open-pore body 222. For example, a die may be loaded with adsorptive particles 402 and compacted to form a green material. Spark plasma sintering may then be used to selectively apply electric charge to different regions of the green material to form different porous structures. For example, a first electric current may be applied only to a core 702 region of the monolith during formation, and then a second electric current may be applied only to a shell region around the core 702 region. These regionally applied currents may create different degrees of porosity throughout a monolithically formed structure, e.g., a less porous core 702 region surrounded by a more porous shell region.

In an embodiment, extrusion techniques may be used to form a rigid open-pore body 222. Adsorptive particles 402 in powder form may be mixed with a chemical binder and then extruded through a die to form, e.g., a monolithic open-pore body 222 having a cylindrical shape. The open-pore body 222 may then be shaped using machining techniques to remove material and shape the open-pore body 222 into the desired final structure that conforms with speaker housing 202.

In an embodiment, scaffolding techniques may be used to form a rigid open-pore body 222. A scaffold having a macroscopic structure may be formed from a polymer. For example, a polymer may be shaped into sponge-like structure having interconnected pores or passages. Adsorptive particles 402, e.g., adsorptive powders, may then be sprayed onto the sponge-like scaffold to surround 208 the polymer scaffold and partially fill the scaffold pores. In an embodiment, the sprayed adsorptive material may include interconnected macropores 302. The macroscopic porosity of the sprayed structure may vary depending on the porosity of the initial polymer scaffold. Thus, a rigid open-pore body 222 may be formed from the coated scaffold.

The above processing techniques are provided by way of example and not limitation. For example, other processes, such as mixing adsorptive particles 402 with a chemical binder and then applying a catalyst to cause solidification of the binder and bonding of the adsorptive particles 402 may be used. Thus, a person of ordinary skill in the art will appreciate that numerous processing techniques may be used to bond adsorptive particles 402 to form a rigid open-pore body 222 having interconnected macropores, which may be used as a component of adsorptive insert 220.

Figure 15:
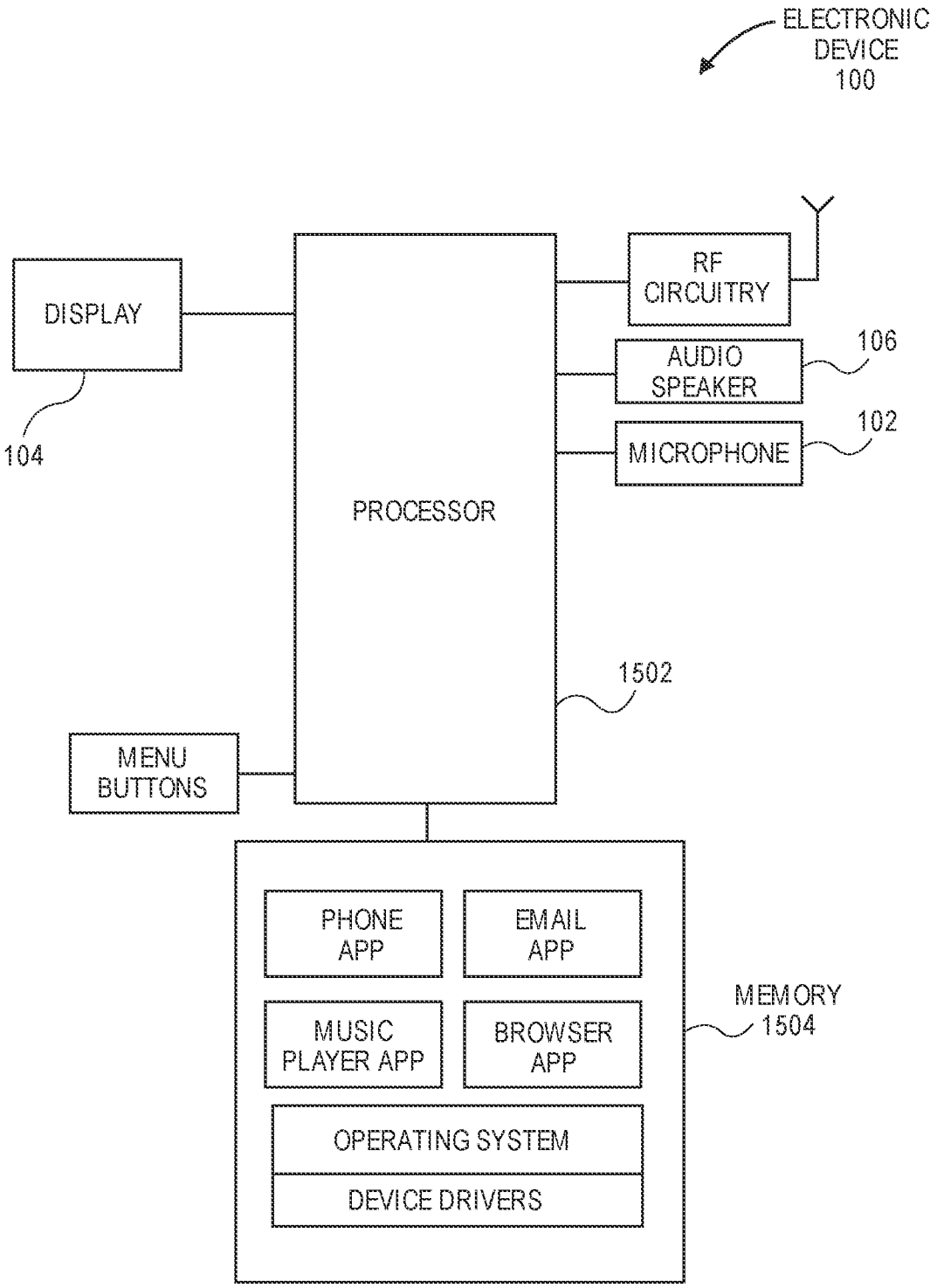
FIG. 15 is a schematic view of an electronic device having an audio speaker in accordance with an embodiment.

Referring to FIG. 15, a schematic view of an electronic device having an audio speaker is shown in accordance with an embodiment. As described above, electronic device 100 may be one of several types of portable or stationary devices or apparatuses with circuitry suited to specific functionality. Thus, the diagrammed circuitry is provided by way of example and not limitation. Electronic device 100 may include one or more processors 1502 that execute instructions to carry out the different functions and capabilities described above. Instructions executed by the one or more processors 1502 of electronic device 100 may be retrieved from local memory 1504, and may be in the form of an operating system program having device drivers, as well as one or more application programs that run on top of the operating system, to perform the different functions introduced above, e.g., phone or telephony and/or music play back. For example, processor 1502 may directly or indirectly implement control loops and provide drive signals to voicecoil 212 of audio speaker 106 to drive diaphragm 206 motion and generate sound. Audio speaker 106 having the structure described may adsorb and desorb randomly traveling air molecules as pressure fluctuates due to the generated sound. As a result, audio speaker 106 may have a higher efficiency at lower frequencies, as compared to a speaker without an adsorptive insert. Thus, audio speaker 106 may produce loud, rich sound, comparable to that of a much larger speaker, but within the form factor of a micro speaker.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An audio speaker, comprising:

a speaker housing having a speaker port and an inner surface;

a loudspeaker mounted in the speaker port to define a back volume between the loudspeaker and the inner surface; and an adsorptive insert in the back volume, wherein the adsorptive insert includes a plurality of adsorptive particles bound together to form an open-pore body having a hierarchical network of macropores to transport air from the back volume at an outer surface of the adsorptive insert to a center of the adsorptive insert, and wherein the adsorptive insert has a lower density at the outer surface than at the center.

2. The audio speaker of claim 1, wherein the hierarchical network of macropores occupies less than 60% of a spatial volume of the open-pore body.

3. The audio speaker of claim 2, wherein the plurality of bonded adsorptive particles occupy a majority of the spatial volume of the open-pore body.

4. The audio speaker of claim 3 wherein the spatial volume of the open-pore body occupies a majority of the back volume.

5. The audio speaker of claim 1, wherein substantially all of the outer surface is spaced apart from the inner surface.

6. The audio speaker of claim 5 further comprising an open-cell spacer between the outer surface and the inner surface.

7. The audio speaker of claim 6, wherein the open-cell spacer includes an open-cell foam material.

8. The audio speaker of claim 7, wherein the adsorptive insert includes one or more protrusions extending from a surrounding portion of the outer surface, the protrusions having respective apices mounted on the inner surface.

9. The audio speaker of claim 8, wherein a portion of the outer surface spaced apart from the inner surface includes an outer contour opposing an inner contour of the inner surface, and wherein the outer contour conforms to the inner contour.

10. The audio speaker of claim 9, wherein the conforming outer contour and inner contour are selected from a group consisting of corners and curvatures.

11. A device, comprising:

an audio speaker including:

a speaker housing having a speaker port and an inner surface, a loudspeaker mounted in the speaker port to define a back volume between the loudspeaker and the inner surface, and an adsorptive insert in the back volume, wherein the adsorptive insert includes a plurality of adsorptive particles bound together to form an open-pore body having a hierarchical network of macropores to transport air from the back volume at an outer surface of the adsorptive insert to a center of the adsorptive insert, and wherein the adsorptive insert has a lower density at the outer surface than at the center; and one or more processors configured to drive the audio speaker.

12. The device of claim 11, wherein the hierarchical network of macropores occupies less than 60% of a spatial volume of the open-pore body.

13. The device of claim 12, wherein the plurality of bonded adsorptive particles occupy a majority of the spatial volume.

14. The device of claim 13, wherein the spatial volume occupies a majority of the back volume.

15. The device of claim 11, wherein substantially all of the outer surface is spaced apart from the inner surface.

16. The device of claim 15 further comprising an open-cell spacer between the outer surface and the inner surface.

17. A method, comprising:

providing a speaker housing having a speaker port and an inner surface defining a rear cavity;

providing an adsorptive insert including a plurality of adsorptive particles bound together to form an open-pore body having a hierarchical network of macropores, wherein the adsorptive insert has a lower density at an outer surface of the adsorptive insert than at a center of the adsorptive insert;

inserting the adsorptive insert into the rear cavity; and mounting a loudspeaker in the speaker port to define a back volume between the loudspeaker and the inner surface, wherein the hierarchical network of macropores transport air from the back volume at the outer surface of the open-pore body to the center of the adsorptive insert.

18. The method of claim 17 further comprising bonding the plurality of adsorptive particles to form the open-pore body, wherein the bonding includes applying one or more of heat or pressure to the plurality of adsorptive particles such that the hierarchical network of macropores occupies less than 60% of a spatial volume of the open-pore body.

19. The method of claim 18 further comprising removing bonded adsorptive particles from the open-pore body to shape a portion of the outer surface into an outer contour, and wherein the outer contour has a same shape as an inner contour of a portion of the inner surface.

20. The method of claim 19 further comprising positioning an open-cell spacer between the outer surface and the inner surface such that all of the outer surface is spaced apart from the inner surface.

* * * * *